US006398644B1

(12) United States Patent
Perrie et al.

(10) Patent No.: US 6,398,644 B1
(45) Date of Patent: Jun. 4, 2002

(54) PATTERN REVERSE KENO GAME METHOD OF PLAY

(75) Inventors: Kenneth Allan Perrie, Groton, CT (US); Olaf Vancura, Las Vegas, NV (US)

(73) Assignee: Mikohn Gaming Corporation, Las Vegas, NV (US)

( * ) Notice: Subject to any disclaimer, the term of this patent is extended or adjusted under 35 U.S.C. 154(b) by 0 days.

(21) Appl. No.: 09/218,500

(22) Filed: Dec. 22, 1998

Related U.S. Application Data

(60) Provisional application No. 60/083,658, filed on Apr. 30, 1998, and provisional application No. 60/068,624, filed on Dec. 23, 1997.

(51) Int. Cl.[7] ..... A63F 9/22

(52) U.S. Cl. ..... 463/18; 273/264; 273/138.1; 273/139; 463/19

(58) Field of Search ..... 463/17–20, 22, 463/9; 273/267, 268, 269, 270, 274, 292, 138.1, 138.2, 139, 460

(56) References Cited

U.S. PATENT DOCUMENTS

| | | | | | |
|---|---|---|---|---|---|
| 5,401,024 | A | * | 3/1995 | Simunek | 463/18 |
| 5,580,053 | A | * | 12/1996 | Crouch | 463/20 |
| 5,755,619 | A | * | 5/1998 | Matsumoto et al. | 463/18 |
| 5,944,605 | A | * | 8/1999 | Pajitnov | 463/9 |
| 6,015,346 | A | * | 1/2000 | Bennett | 463/17 |

FOREIGN PATENT DOCUMENTS

| | | | | | |
|---|---|---|---|---|---|
| EP | 0 862 152 | A1 | | 9/1998 | |
| EP | 0 874 337 | A1 | | 10/1998 | |
| EP | 0 875 870 | A2 | | 11/1998 | |
| GB | 2229371 | A | * | 12/1990 | 273/460 |
| GB | 2252705 | A | * | 12/1992 | 273/460 |
| GB | 2271262 | A | * | 6/1994 | 463/460 |
| WO | WO 98/09258 | | | 3/1998 | |
| WO | WO 98/09259 | | | 3/1998 | |

OTHER PUBLICATIONS

John Scarne, Scarne's New Complete Guide to Gambling, 1974, pp. 490–499. Simon & Schuster, Inc., New York, New York.

* cited by examiner

*Primary Examiner*—Michael O'Neill
*Assistant Examiner*—Sheila Clayton
(74) *Attorney, Agent, or Firm*—Dorr, Carson, Sloan & Birney, P.C.

(57) ABSTRACT

A virtual matrix comprised of a plurality of grid elements is provided, on which a hidden pattern, comprised of a plurality of matrix entries, is randomly placed. A player views a gaming matrix having a plurality of visible positions, each visible position corresponding to one of the grid elements. The player chooses at least one of the plurality of visible positions on the gaming matrix, after which the game displays the corresponding grid element of the virtual matrix on the gaming matrix. Based on the correct number of guesses matching the pattern location, the player is awarded and a media presentation signals the player's success. If the player guesses incorrectly, a second media presentation signals the incorrect guess.

66 Claims, 10 Drawing Sheets

Fig. 2
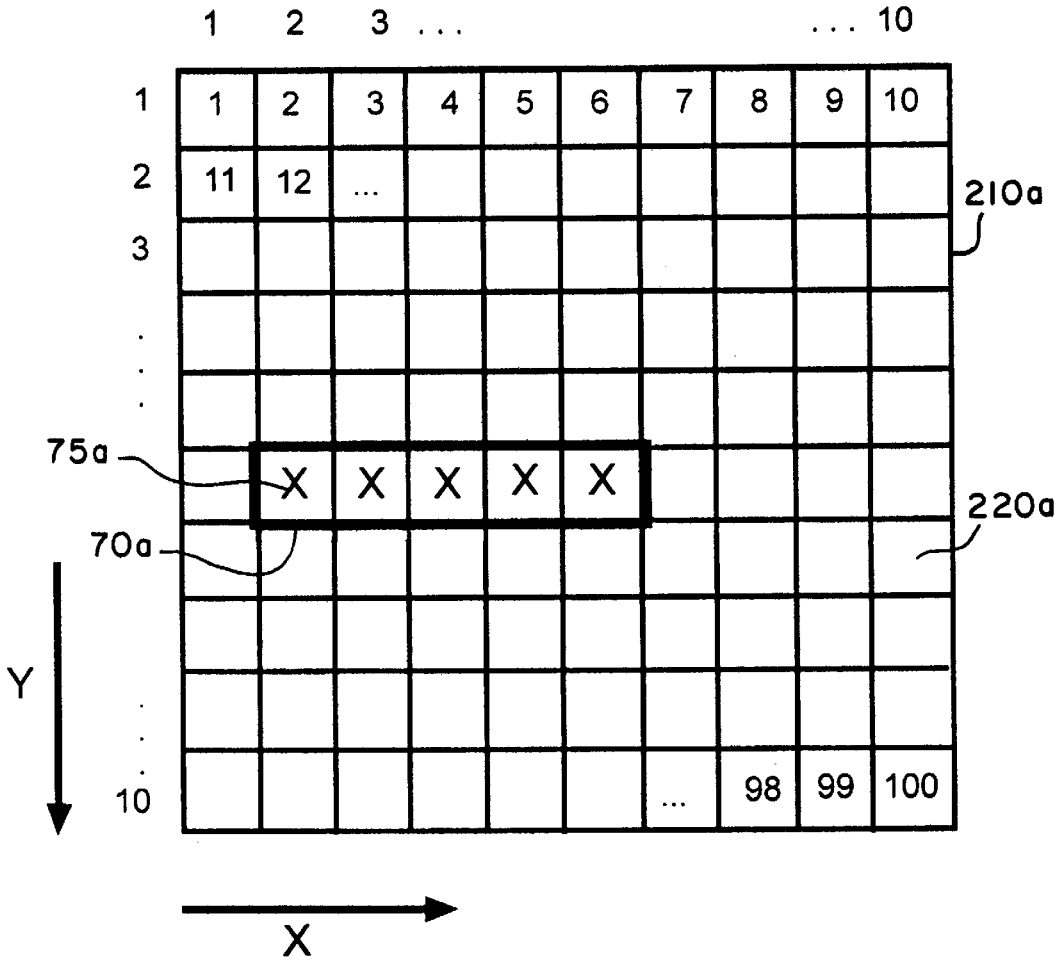
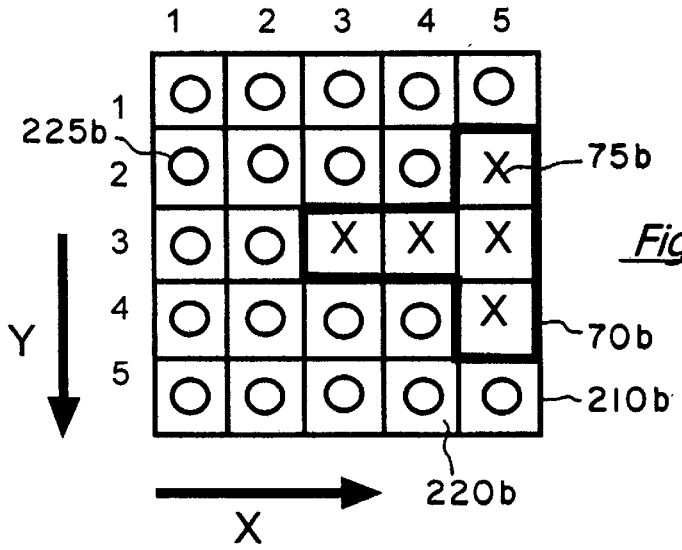
Fig. 3

START
600
CLEAR VIRTUAL MATRIX
610
PLACE HIDDEN PATTERN
620
60
RNG
PATTERN
200
RECEIVE PLAYER INPUT
630
DISPLAY RESULT
640
Solve ?
650
Yes
No
RECEIVE PLAYER INPUTS
630a
Done ?
660
No
Yes
DISPLAY RESULTS
640a
Match ?
670
Yes
AWARD PLAYER
680
No
OVER
690

120c 110c

| | | | | | | |
|---|---|---|---|---|---|---|
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | 32 | 33 | 34 | 35 |
| 36 | 37 | 38 | 39 | 40 | 41 | 42 |
| 43 | 44 | 45 | 46 | 47 | 48 | 49 |

*Fig. 7(a)*
*( Prior Art )*

*Fig. 7 (b)*
*( Prior Art )*

| | | | | | | |
|---|---|---|---|---|---|---|
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | 32 | 33 | 34 | 35 |
| 36 | 37 | 38 | 39 | 40 | 41 | 42 |
| 43 | 44 | 45 | 46 | 47 | 48 | 49 |

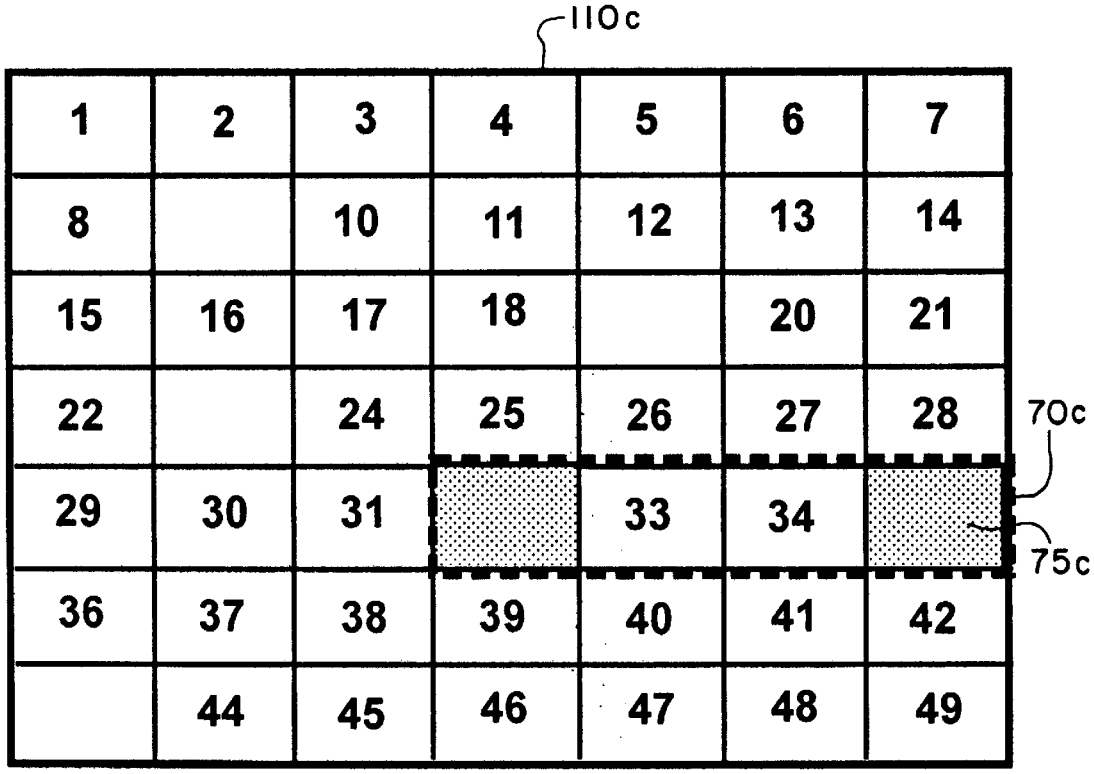
Fig. 7(c)
Fig. 7(d)
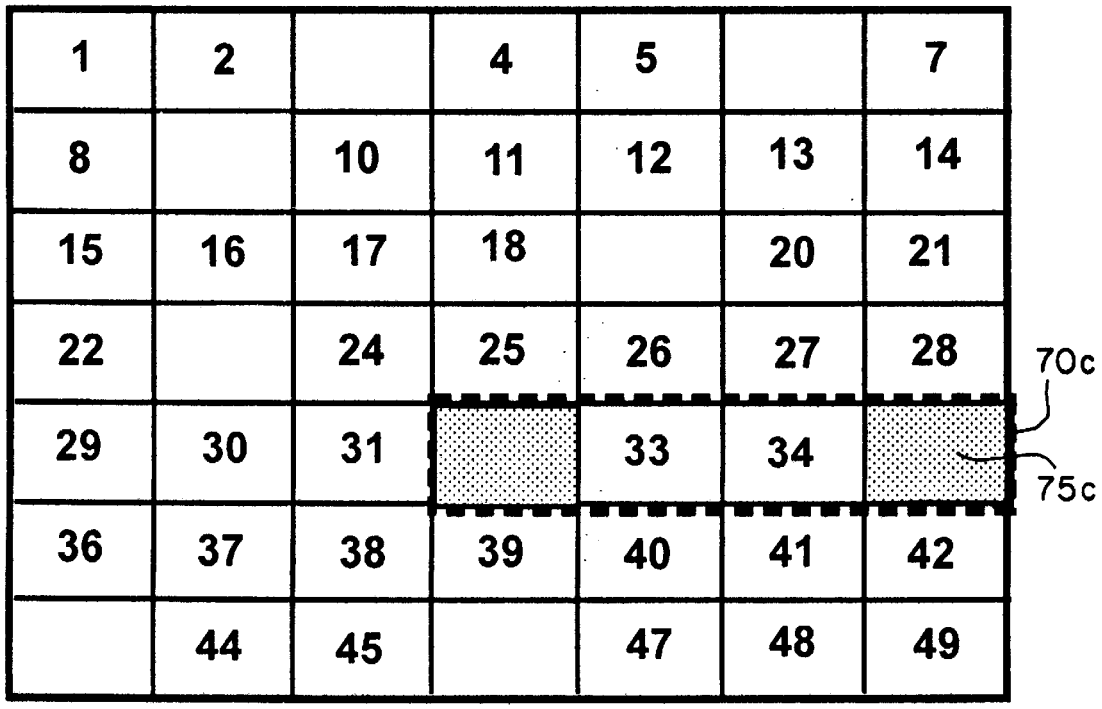

PATTERN REVERSE KENO GAME METHOD OF PLAY

RELATED INVENTION

This application claims priority to two provisional patent applications Ser. No. 60/068,624 filed Dec. 23, 1997 and Ser. No. 60/083,658 filed Apr. 30, 1998, entitled "PATTERN REVERSE KENO GAME METHOD OF PLAY."

BACKGROUND OF THE INVENTION

1. Field of the Invention

The present invention pertains to games suitable for play in a casino and, more particularly, to a modified form of keno.

2. Statement of the Problem

Casino keno, and its close relative, the lottery, generally have the player select a plurality of numbers (lottery) or numbered positions (keno), followed by the house randomly selecting a plurality of numbered balls. Wagers are settled based on the number of matching numbers (or numbered positions). For example, the New York State LOTTO game allows players to select six different numbers in the range 1 to 54, inclusive. Thereafter, the state randomly, and without replacement, draws six numbered balls from a pool of 54 balls (numbered from 1 to 54). Other states, and often other games within a state, employ slightly different schemes. For example, in Massachusetts, the MASS MILLIONS game chooses six balls from a field of 49. MASS CASH, on the other hand, chooses 5 balls from a field of 35, and so forth. Players are generally rewarded for obtaining 3 or more matches. Casino and state-run keno, however, are typically games of chance.

Some keno games allow players to choose patterns of numbers on their tickets. Higher payoffs are made when such patterns are hit. However, players do not develop strategies because the pattern is chosen by the house at random after the player has made a selection.

A need exists to provide new games with the familiar keno matrix format incorporating a new type of game contained therein, such as that found in popular home games. One popular home game involving a matrix of numbered positions is the game of BATTLESHIP trademarked by Hasbro, Inc. In the BATTLESHIP game, each player has a target grid and an ocean grid. To play the game each player secretly places a fleet of five ships on their respective ocean grid. Once the ships are placed, they cannot be changed. Players take shots by calling out a letter and a number to identify a location on the target grid. As a shot is made, the other player informs the shooter whether a boat on his ocean grid has been hit or not. When a hit occurs, the shooter places a red peg in the identified location of the target grid for a hit and a white peg for a miss. The first player to sink all five of the opponent's ships becomes the winner. In the play of this game, each ship occupies a certain number of locations of the grid. For example, a battleship occupies four locations whereas as a submarine has three locations, etc. Essentially, the players use their skill to identify the ship and the location of the ship on the target grid to sink the other's fleet.

A continuing need also exists for new casino wagering games and for variations and modifications thereto, and in particular to games that will keep the player's attention by allowing the player to develop a strategy.

SUMMARY OF THE INVENTION

1. Solution to the Problem

The present invention is different from conventional keno or lotto games in that the player of the present invention may employ a unique strategy to solve an underlying puzzle thereby meeting the aforesaid needs. Even an incorrect guess by the player eliminates possible choices. Thus the player is able to continue developing a strategy for uncovering a hidden pattern or patterns in a modified Keno game. When utilized as a bonus game, a player tends to play underlying games longer, because with each play the player draws closer to solving the puzzle in the bonus game. Another advantage of the present invention, whether utilized as a stand-alone game or as a bonus game, is the potential for larger jackpots for a player who uncovers the pattern in a minimal number of guesses or who uncovers larger, more complex, or even multiple patterns.

2. Summary

The present invention sets forth a method for playing a keno-type casino game. A virtual matrix comprised of a plurality of grid elements is provided, on which a pattern hidden from the player is randomly placed. The hidden pattern is comprised of a plurality of matrix entries. The player is unable to view or have knowledge of the virtual matrix. However, the player is able to view a gaming matrix which has a plurality of grid elements. Each visible position corresponds to one of the grid elements on the virtual matrix. In response to either the player submitting a wager, or winning a play as part of a bonus condition occurring in an underlying game, the player chooses at least one of the plurality of visible positions on the gaming matrix. The game of the present invention then displays, on the gaming matrix, the contents of the corresponding grid element of the virtual matrix. The game can either accept another choice from the player, or allow the player to guess the remaining visible positions where the player believes the hidden pattern is positioned. If the player guesses correctly and uncovers the hidden pattern, the player is awarded and a media presentation signals the player's success. If the player guesses incorrectly, a second media presentation signals the incorrect guess.

In some embodiments of the method of the present invention, the player receives payoff multiples that are higher when the pattern is identified with a minimal number of misses.

In some embodiments of the method of the present invention, a number of hidden patterns are provided and the player receives a payoff for solving each separate hidden pattern.

Finally, a number of other embodiments, variations, and versions of the method of the present invention are set forth.

BRIEF DESCRIPTION OF THE DRAWINGS

FIG. 2 shows a virtual matrix of a first embodiment of the method of the present invention.

FIG. 3 shows a virtual matrix of a second embodiment of the method of the present invention.

FIGS. 7(*a*), 7(*b*), 7(*c*), and 7(*d*) represent a variation of the method of the present invention based upon a prior art Keno game.

DETAILED DESCRIPTION OF THE INVENTION

Figure 1:
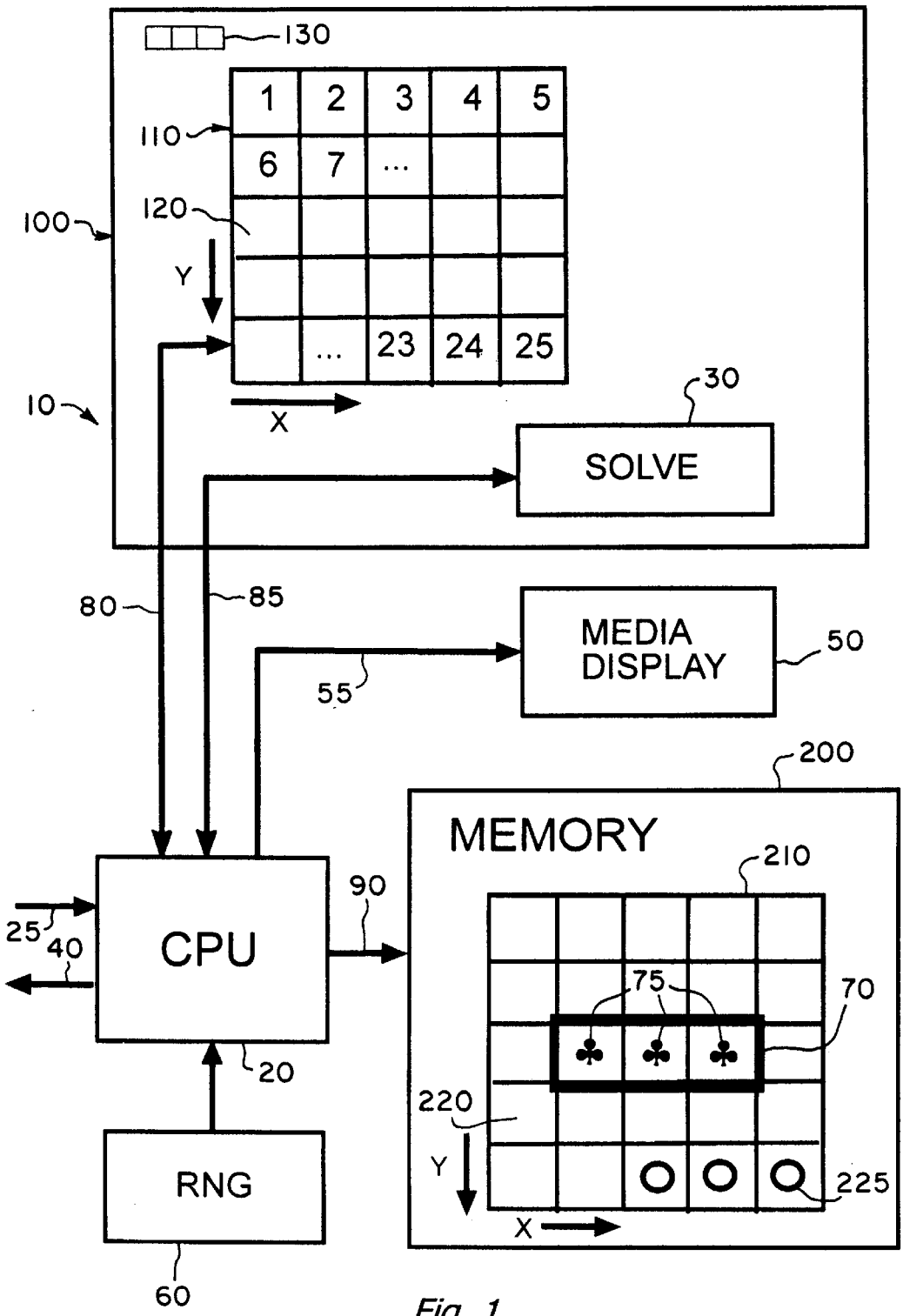
FIG. 1 is a block diagram illustrating the components of the present invention.

1. Overview The present invention provides a method for reversing and expanding the traditional play of keno by introducing novel hidden patterns into the game. FIG. 1 generally outlines one preferred embodiment for the system 10 of the present invention. The system 10 includes central processing unit (CPU) 20, media display 50, an activation signal received over line 25, a payout signal received over line 40, random number generator (RNG) 60, video screen 100, a memory 200 and, optionally, a solve indicator 30.

The CPU 20 of the present invention receives an activation signal over line 25 indicating that either a wager has been placed, or a bonus game condition has occurred in an underlying game, or any other condition signaling play to commence. Media display 50 may be used to entice players to play the game 10, or to let the player know the game 10 is about to start. The media display may be audio, digital, graphic, and/or a combination thereof and may have different presentations stored in memory 200 for different stages of game play. The media display 50 could also be incorporated into display 100. The media display 50 could also be a separate computer-based media system.

The CPU 20 next generates or uses a virtual matrix 210, which is stored in memory 200 (or the internal memory of the CPU 20). The preferred embodiment uses a two-dimensional virtual matrix 210 having X and Y-axises as shown and, therefore, the following will be described with respect to a two-dimensional matrix. However, the game of the present invention is not limited to a two-dimensional matrix and a one-dimensional or multi-dimensional matrix could also be used. The virtual matrix 210 is comprised of a plurality of grid elements 220, and is kept hidden from the player of the present invention (i.e., in computer memory 200). The player is able, however, to view the gaming matrix 110 on video screen 100. The gaming matrix 110 is comprised of a plurality of visible positions 120, each visible position 120 corresponding to one of the grid elements 220 of the virtual matrix 210 in the X and Y-axis.

A representation of the hidden pattern 70 is displayed on the screen 100 in area 130 so that the player knows the shape of the pattern 70 and the number of matrix elements 75 of the pattern 70. In some methods of the present invention, this display 130 may be a display separate from screen 100 or simply a printed diagram.

The present invention uses a random number generator 60 (or suitable software) to randomly place the hidden pattern 70, comprised of one or more matrix entries 75, onto the virtual matrix 210. This occurs in response to the first signal on line 25 indicating start of the game 10. In FIG. 1, the hidden pattern 70 is a rectangular bar composed of three matrix elements 75. In practice, the hidden pattern 70 can be quite robust, and it thus provides for considerable variety in play. Each matrix entry 75 can also be a shape (i.e., the clover shown in FIG. 1) or letters of the alphabet, which when combined to create the hidden pattern 70, form a compound image or a word. Alternatively, each hidden pattern 70 or matrix entry 75 together can represent an establishment logo or other icon. Or, the pattern 70 may be a geometric shape (e.g., a cross composed of shaded areas 75). The matrix entries 75 and the pattern 70 can be any of innumerable colors, shapes, designs, etc., and the method of the present invention is not limited by a particular pattern 70 or matrix entry 75. Furthermore, more than one pattern 70 can be used and each different pattern 70 can have different matrix entries 75.

After the hidden pattern 70 has been randomly placed by the CPU 20 in the virtual matrix 210, the player is given a number of "guesses" or "shots" (e.g., six guesses or 10 misses, etc.) with which to uncover the hidden pattern 70 by selecting visible positions 120 (such as by touching) on the video screen 100. This player input is received over line 80 by the CPU 20. CPU 20 then retrieves the content of corresponding grid element 220 of the virtual matrix 210 and displays it in the selected and corresponding visible position 120 on the gaming matrix 110 at the same x, y location. If the corresponding grid element 220 contains a matrix entry 75 of the hidden pattern 70, that matrix entry 75 is displayed in the selected visible position on the gaming matrix 110 (i.e., a "hit" is indicated). Likewise, when the corresponding grid element 220 does not contain a matrix entry 75 of the hidden pattern 70, an empty indicator 225 (e.g., the words "empty," an "O," other indication) may be displayed in the selected visible position 120 of the gaming matrix 110 (i.e., a "miss" is indicated). In some embodiments of the method of the present invention, a "miss" may not be indicated, thereby leaving it to the player to remember not to touch that visible element again. A message or other indication may also be displayed with media display 50, corresponding to whether a matrix entry 75 of the hidden pattern 70 was uncovered, or whether the entire hidden pattern 70 has been uncovered. This process continues with each guess until the player runs out of a given number of guesses (or misses) or the hidden pattern 70 is uncovered. The media display 50 may also be used to indicate the player has run out of guesses and must start over.

In one embodiment of the method of the present invention, the player may choose to solve the puzzle (e.g., to touch the remaining locations of the hidden pattern 70 on video screen 100) at any time during play of the game, or by activating the optional solve device 30. If the optional solve device 30 is included, after receiving a signal from solve device 30 over line 85, the CPU 20 accepts signals over line 80 from the gaming matrix for each visible position 120 indicated by the player until either an indicated visible position 120 does not match a matrix entry 75 of the hidden pattern 70 (i.e., a miss), or the player correctly identifies each remaining visible position 120 corresponding to each matrix entry 75 of hidden pattern 70, at which time the game is ended. A separate solve feature need not be included in the present invention, however, and the player could simply choose the grid elements (i.e., the visible portions 120) corresponding to the known location of the hidden pattern 70. In such an embodiment, the paytable would simply be adjusted according to the total number of guesses.

In one embodiment of the method of the present invention, a single match to an element of the hidden pattern 70 is sufficient to reveal the entire pattern 70. In this fashion, the game can be faster, but the element of strategy still remains. Also in this embodiment, multiple hidden patterns 70 may be employed to create a compound pattern. In this case, a single hit to any one matrix element 75 in each hidden pattern may be required, or simply one hit to any one matrix element 75 in any one pattern may reveal the entire compound pattern. For example, if two patterns each consisting of 3 matrix elements are hidden, then the game may be played in one of three ways: 6 hits may be required to completely uncover the two hidden patterns (each hit uncovers only one matrix element), 2 hits may be required to completely uncover the two hidden patterns (each hit uncovers the corresponding hidden pattern), or 1 hit may be required to completely uncover two hidden patterns (the 1 hit on any one of the two patterns uncovers both hidden patterns). The term hidden pattern used herein includes not only one hidden pattern, but a number of hidden patterns sometimes referred to as a compound hidden pattern. The hidden pattern can be formed of non-adjacent matrix entries, adjacent matrix entries, groups of adjacent matrix entries, etc.

Payoffs are established based either on the number of successful hits (identifications) when the solve area 30 is touched, or the number of matches (i.e., hits) to hidden pattern 70 in light of the total number of guesses. Payoffs can be based on, for example, the number of individual matrix entries 75, individual hidden patterns 70, or to multiple hidden patterns 70 that are matched by the player during play of the game. The solve feature will be described in greater detail below. However, if a solve area 30 is not included, the number of incorrect guesses (i.e., misses) may be factored into the payoff table as a design choice so that, for example, a player uncovering hidden pattern 70 immediately with only a few misses would receive a higher award than a player who uncovers hidden pattern 70 only after a large number of misses. How the award is modified based upon misses, hits, guesses, and/or a combination thereof is left to design choice under the teachings contained herein. Payoffs may also be given for each correct hit (regardless of misses), for each successful complete identification of a hidden pattern, and/or for identifying the entire compound hidden pattern. The player may receive any suitable award such as a payoff corresponding to the units of the wager (or wagers), objects such as vehicles, tickets, comps such as free dinners, credits, free games, multiples of awards, or any other benefit for the player.

It is to be expressly understood that the system 10 shown in FIG. 1 represents one block diagram approach of the teachings of the present invention. It is functionally described and any of a number of different components, designs, arrangements, or electronic memory, processors, graphic displays, video displays, and/or random number generators, could be utilized to incorporate the teachings and methods of the present invention contained herein. Many of the details of operating conventional gaming devices such as reel-based slot machines, video-based poker games, coin acceptors, card readers(credit, debit, smart, etc.) are well known and are not important to the teachings of the present invention other than in a functional approach. It is well known how to place bets, recognize the amount bet, and award the winning player based upon a pay table stored in memory 200. Therefore, the method and teachings of the present invention can be incorporated into a stand-alone casino game such as commonly seen with stand-alone keno, slot, and poker games. Or, the game can be incorporated as a choice of games so that a player coming to the gaming machine can select a game from a menu of games and the present game could be one of the choices. Or, the present invention can be incorporated over a network so that players can play in hotel rooms, at casinos, or over a communication network at their home by playing the game on their home personal computer. In the latter situation, the home or room computer would communicate over the communications network with a centrally located computer which would have memory 200 random number generator 60, etc. How the method of the present invention is incorporated, whether as a stand-alone game or as a bonus game, can be one of many equivalent designs.

2. Details of Pattern Placement FIG. 2 illustrates one embodiment for randomly placing a hidden pattern 70*a* on a virtual matrix 210*a* in memory 200 by CPU 20. Grid elements 220*a* are designated along the X-axis from 1 to 10 and along the Y-axis from 1 to 10. The grid elements 220*a* in FIG. 2 are numbered 1 to 100. The following discussion will refer to specific grid elements 220*a* by their column-row designation (i.e., (x,y)).

In FIG. 2, a 10×10 virtual matrix 210*a* is shown onto which a rectangular pattern 70*a* (comprised of 1×5 matrix entries 75*a*) is randomly placed. It is to be expressly understood that while a 10×10 matrix is shown, that the virtual matrix 210*a* may be any size or dimension. In addition, while hidden pattern 70*a* is shown as a rectangle placed horizontally on virtual matrix 210*a*, hidden pattern 70*a* may take any form or orientation on the virtual matrix 210*a*. For example, the hidden pattern 70*a* may have uneven dimensions, be separated by grid positions 220*a* that do not contain matrix entries 75*a*, or contain a plurality of individual discontiguous hidden patterns 70*a*. Likewise, as discussed above, the hidden pattern 70*a* may be comprised of any suitable matrix entries 75*a* such as a series of letters or icons. In FIG. 2, the icon is an "X." In addition, the CPU 20 may randomly generate different hidden patterns 70*a*, or the player may be allowed to select the hidden pattern 70*a* from a plurality of hidden patterns, before the hidden pattern 70*a* is positioned on the virtual matrix 210*a* for each game. In this latter embodiment, more difficult patterns would have higher payoffs.

Of course, in the preferred embodiment of the present invention the player must know in advance of the play what the hidden pattern is. In an alternative version, the player plays to uncover a random pattern with knowledge of a set of possible random patterns from which the hidden pattern 70 was chosen. For example, the hidden pattern 70 itself may be indicated simply as a letter of the alphabet; in this case the player would have to determine which letter was hidden as an additional strategem. In another alternative version, the player has no knowledge of the hidden pattern 70. Hence, the hidden pattern 70 can be displayed as shown in FIG. 1, at location 130 on the monitor 100, or it can be permanently affixed to the game (when the fixed pattern is always the same). Or, CPU 20 can allow the player to select the hidden pattern 70 from a menu containing a number of hidden patterns, then display the hidden pattern 70 in an area 130 of the screen so that the player can easily refer to it as the player is seeking to uncover the hidden pattern 70 in the gaming matrix 110.

One technique used by CPU 20 to randomly position hidden pattern 70*a* on virtual matrix 210*a* is to first randomly choose an orientation (horizontal or vertical), and then to randomly choose a grid element 220*a* for the left-(if horizontal) or lower-(if vertical) most matrix entry 75*a* of the pattern 70*a*. In FIG. 2, the hidden pattern 70*a* starts at grid position (2,6) and extends horizontally to grid position (6,6). Using this technique, the lower- or left- most matrix entry 75*a* of hidden pattern 70*a* may be situated anywhere starting in the first six grid positions 220*a* along the X-axis (e.g., (1,1), (1,2), . . . (1,10), (2,1), (2,2), . . . (6,10)) if horizontal, or anywhere starting in the lower six grid positions along the Y-axis (e.g., (1,10), (1,9), . . . (1,6), (2,10), (2,9), . . . (10,6)) if vertical, so as to fit hidden pattern 70*a* completely within virtual matrix 210*a*. Thus, if each of the possible placements for the lower- or left- most matrix entry 75*a* are weighted equally (6×10×2=120), the present invention has an algorithm for randomly placing the pattern 70*a* in 120 possible positions of the 10×10 virtual matrix 210*a* based upon the random number generator 60.

Multiple hidden patterns 70*a* may also be randomly placed using this procedure in a sequential fashion, with the additional step of checking that the pattern to be placed does not overlap any prior placed hidden patterns 70*a* on the virtual matrix 210*a*.

Although an explicit method for placing a hidden pattern 70*a* on a virtual matrix 210*a* has been set forth, this method is only intended as an example to illustrate one of many possible algorithms. It is not meant to limit the possible hidden patterns 70*a* or the means by which random placement is achieved. Indeed, the random placement of the pattern(s) may be constructed so as to bias the placement toward a certain region of the virtual matrix, if desired.

Figure 4:
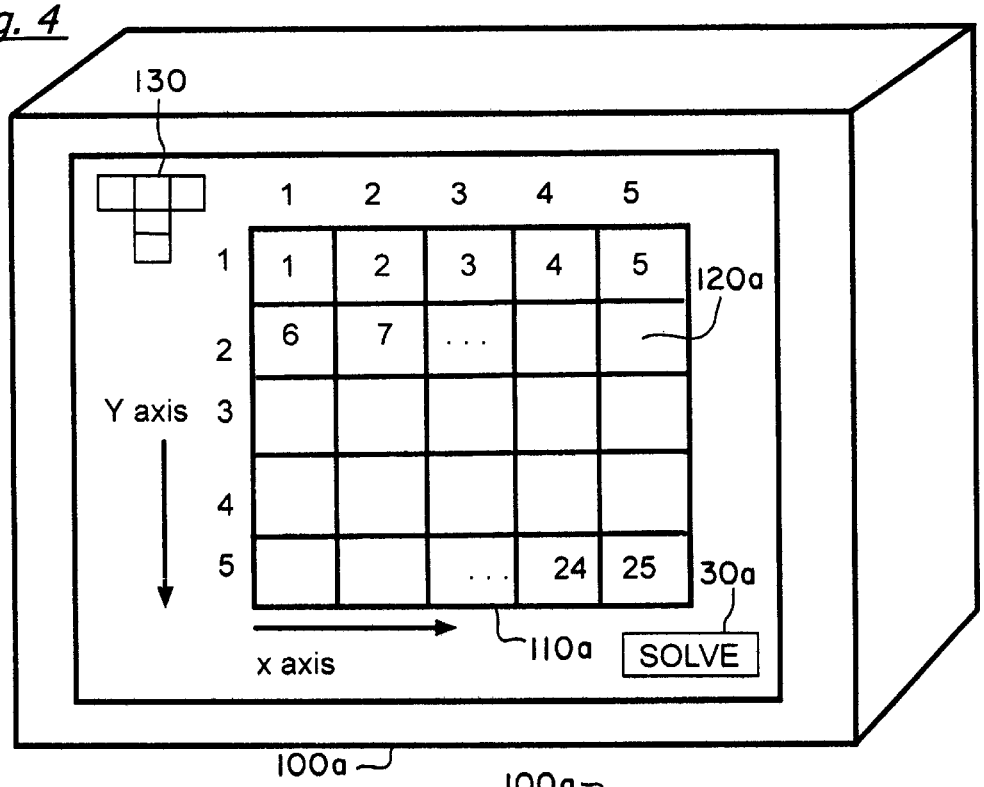
FIG. 4 shows a video gaming matrix corresponding to the virtual matrix of FIG. 3.
Figure 5:
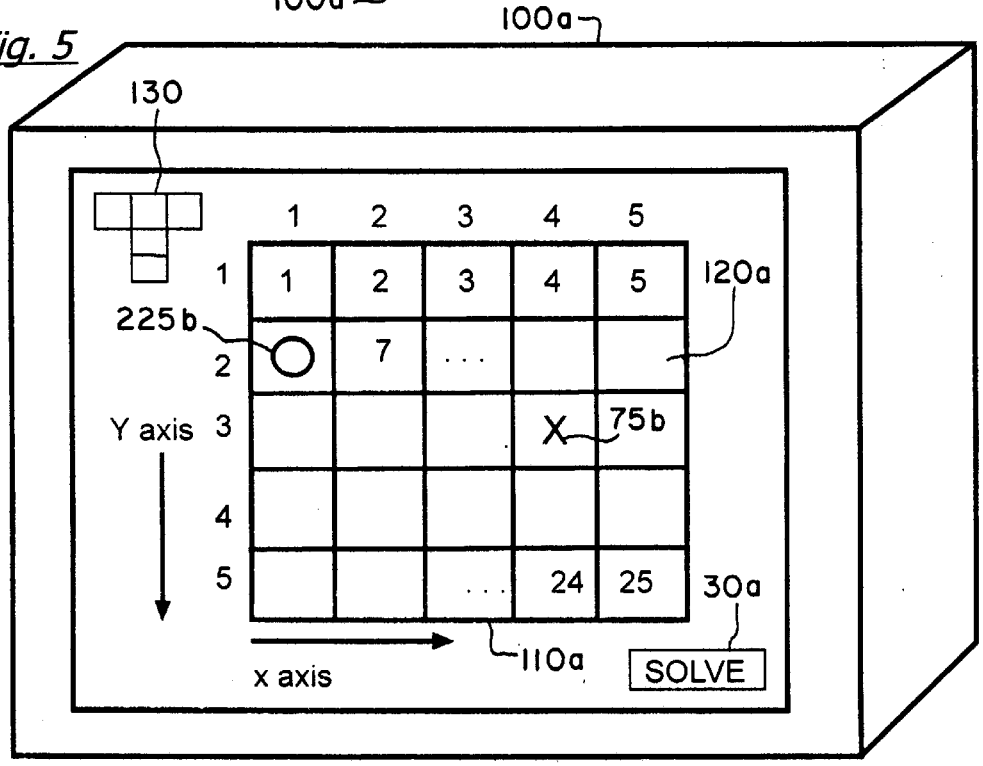
FIG. 5 shows the video gaming matrix of FIG. 4 illustrating the player's guesses.

3. Details of the Method of Play FIGS. 3, 4, and 5 illustrate one method for playing the game of the present invention. FIG. 3 shows a hidden pattern 70*b* (T-shaped in this illustration) randomly placed on a 5×5 virtual matrix 210*b* by CPU 20 that is used in conjunction with video screen 100*a*, shown in FIGS. 4 and 5. FIG. 4 shows video screen 100*a* before play begins (i.e., no visible positions 120*a* have been selected by the player) and the shape of the hidden pattern 70*b* shown in area 130. FIG. 5 shows the video screen 100*a* of FIG. 4 after two visible positions 120*a* have been selected by a player first at (1, 2) which is a "O" and second at (4,3) which is an "X." The numbering 1 through 25 may or may not be displayed. The X and Y number may or may not be displayed.

Although FIGS. 4 and 5 show a video screen 100*a*, gaming matrix 110*a* may be displayed in any convenient manner, such as mechanically displayed, and need not have visible positions at each coordinate of gaming matrix 110*a*. It is only important that each visible position 120*a* correspond to a grid element 220*b* of virtual matrix 210*b*.

In FIG. 3, the hidden pattern 70*b* before, at, or after (i.e., contemporaneously with) the start of the game is randomly placed on virtual matrix 210*b* by CPU 20, such that each grid element 220*b* is comprised of an "O" (indicating there are no matrix entries 75*b* of the hidden pattern 70*b* at that grid element 220*b*) or a matrix entry 75*b* (e.g., an "X" to indicate a portion of the hidden pattern 70*b* is evident at that grid element 220*b*). An executable computer software program contained in CPU 20 brokers the game according to the following description.

In FIG. 4, the video screen 100*a* displays a two-dimensional gaming matrix 110*a* in which each of the visible positions 120*a* are enumerated (i.e., with keno-style numbering, individual labels, matrix locations, borders or patterns). Touch screen areas form the visible positions 120*a* and provide players with the ability to indicate their selection. Or, a separate keyboard or any other suitable input device such as a mouse-activated pointer, not shown, could be used. The player initiates the game by wagering a prescribed number of units. In a preferred method of play, money, gaming chips, credit, or their equivalent may be wagered. Alternatively, the game is initiated as a bonus game to an underlying game (i.e., a slot machine game or a table game). If initiated as a bonus game, it may be initiated once and played to completion, or it may be "visited" as many times as required to complete the pattern. In this case, each "visit" may comprise one guess, one miss (hence, possibly several guesses provided the player is selecting well), and so forth.

Once the game is initiated such as by a signal (i.e., wager for a stand-alone or bonus condition for a bonus game) on line 25, the player is given a predetermined number of guesses with which to completely identify all grid elements 220*b* corresponding to the matrix entries 75*b* of the hidden pattern 70*b*, indicating in the preferred embodiment, their selection by touching visible positions 120*a* on gaming matrix 110*a*. With each guess, the corresponding grid element 220*b* in virtual matrix 210*b* is displayed on gaming matrix 110*a*. For example, if the player chooses the visible position 120*a* at coordinates (1,2) on gaming matrix 110*a* (FIG. 4), the empty indicator 225*b* of grid element 220*b* at coordinates (1,2) on the virtual matrix 210*b* (FIG. 3) is displayed on gaming matrix 110*a*, shown as an "O" in FIG. 5. If the player next selects visible position 120*a* at coordinates (4,3) on gaming matrix 110*a* (FIG. 4), the content of grid element 220*b* at coordinates (4,3) on the virtual matrix 210*b* (FIG. 3) is displayed on gaming matrix 110*a* (in this example, matrix entry 75*b*), shown as an "X" in FIG. 5. In one embodiment including solve area 30*a*, at anytime during guessing, the player can touch the solve area 30*a* and attempt to identify the remaining portions of the hidden puzzle. the earlier the player solves the puzzle during the guesses, The higher the payoff. In a second embodiment not including solve area 30*a*, the player who discovers the location of hidden pattern 70*b* would simply uncover the remainder of hidden pattern 70*b* without any further incorrect guesses, and thus be rewarded with a higher payoff than the player who does not discover the location of hidden pattern 70*b* and instead makes both correct and incorrect guesses before uncovering hidden pattern 70*b*. In either case, should the player be successful in identifying the coordinates of the entire hidden pattern 70*b*, the game is over and the player is paid a predetermined number of units. Should the player run out of guesses and only be partially successful, the game is over and the player is paid a prescribed number of units according to the number of chosen visible positions 120*a* matching grid elements 220*b* containing a matrix entry 75*b*. Should the player run out of guesses and be unsuccessful in identifying any of the hidden pattern 70*b*, the wager is lost.

The present invention is not to be limited by the method of awarding the player. For instance, the player may be paid immediately for each correctly chosen visible position 120 (i.e, hit), or the award may be based on the number of incorrectly chosen visible positions 120 (i.e., misses), the complexity of the hidden pattern 70, the number of guesses taken, or the number of guesses allowed but not used. In addition, the player may be able to continue play of the game by wagering additional units. Indeed, a wide-area-progressive network may be tied to the method of the present invention. Every time the game of the present invention is played, a fraction of the wager is separated and added to the progressive meter (or, a separate progressive wager may be played). At such time as the predetermined sequence of events occurs (i.e., the pattern is uncovered with no misses) the winning player is awarded the progressive amount or a fraction thereof, based on the number of winning players.

The game of the present invention is robust in that it can accommodate varying methods of play. The player can be given a fixed number of guesses, with which to uncover as much of the underlying pattern 220 as possible. Alternatively, the player may be afforded a fixed number of misses, whereby after said number of misses the game is over. Or the player may be given an initial number of guesses, which increment by a predetermined amount based on successful hits. In addition, the player may be given the option to guess the position of hidden pattern 70 at any time during play of the game (i.e., by activating solve device 30 shown in FIG. 1). Other embodiments may include giving the player a predetermined number of guesses, which may be increased by correctly guessing the position of a matrix entry 75, or the player may only be permitted a predetermined number of incorrect guesses. Additionally, the player may be able to take multiple guesses before learning the results of those guesses, or the guess may encompass, for example, a 2×2 array. A successful guess may also be rewarded with another "free" guess.

It is to be expressly understood that more complex and/or compound patterns 70 will lead to more variety in game play. For example, rectangles of dimension 1×5, 1×4, 1×3, 1×3, and 1×2 (i.e., based upon the conventional BATTLESHIP game patterns) could all be situated on the matrix at once. In addition, a multimedia presentation 50 may accompany each successful or unsuccessful match.

The game may also be utilized as a bonus in conjunction with an underlying game(s) (i.e., a slot machine(s)). In the case where the underlying game is a slot machine, the player is rewarded with a guess on the game of the present invention when a predetermined symbol, or combination of symbols appear on the payline of the slot or any bonus condition signal is received from the underlying game. A large number of different bonus condition such as signals, events, triggers, etc. are known in the gaming industry to effectuate bonus play in a bonus game from an underlying game such as a table game, gaming machine, etc. Hence, whenever the symbol to play the bonus game occurs (which is random in the play of the slot machine), the player is able to make one more guess. This continues until the player completes the puzzle. The use of the solve area (or button) 30 is optional.

It is an advantage of this invention that the bonus game may run "in parallel" with the underlying game. Generally, several guesses will be required to uncover the hidden pattern 70. Hence, a player who has partially uncovered the hidden pattern will be more inclined to continue play on the underlying machine in order to revisit the bonus game and finish the pattern. Too, even incorrect guesses are informational strategically, and so a player who is "unlucky" in uncovering the hidden pattern 70 is also encouraged to continue play by virtue of eliminating possible matrix positions 220 where the hidden pattern 70 may be hidden.

4. Details of the Strategy. Generally, the player will want to uncover the entire hidden pattern 70*a* (FIG. 2) with a minimum number of guesses to gain the highest payoff. An advantage of the present invention is that players may develop a strategy for playing the game of the present invention because the player plays a key part in determining the proper grid elements 220*a* to choose. In particular, consider the 10×10 virtual matrix 210*a* and the randomly placed hidden pattern 70*a* shown in FIG. 2 and whose random placement is described earlier. A strategy in which a player chooses a visible position 220*a* located at a corner (e.g., coordinates (1,1)), and thereafter, with each miss, chooses an adjacent element (e.g., at coordinates (1,2), (1,3) and so on), is inferior, as generally in excess of 50 guesses will be required to discover the hidden pattern 70*a*.

A player of the present invention may do substantially better by utilizing the following algorithm, given only as an example using FIG. 2. At each point in the game, the player calculates for each grid element 220*a*, the number of possible positions that a portion of the hidden pattern 70*a* may have at that location. For example, at each corner (1,1), (1,10), (10,1), and (10,10), there are only two possibilities that the hidden pattern 75*a* is positioned there. On the other hand, in each of the center locations of (5, 5); (5, 6); (6, 5); and (6, 6) of virtual matrix 210*a*, there are ten possible positions of the bar 75*a*. This strategy thus comprises, for each guess: performing the above calculation, finding the set of grid elements 220*a* with the greatest number of possible positions, and randomly choosing from among this set. The process continues until the entire hidden pattern 70*a* is revealed. An identical process can be employed for a compound hidden pattern (comprising more than one hidden pattern), by cycling through all hidden patterns in the compound pattern that correspond to a each matrix position.

5. Details of the Bonus Game. The mechanism of utilizing a bonus game is well known. Typically, the pay table on the underlying game is modified somewhat, to allow the bonus game to be played. For example, if an underlying slot machine typically paid 5 coins on 20% of the plays, the pay table may be modified to dispense only 4 coins in these situations, so as to "gain" 0.2 coins per play. Thereafter, if a bonus game occurs every, 100 plays, for example, it literally "costs" twenty coins to participate (0.2×100=20). The connection between stand-alone and bonus versions of the present invention is thus self-evident. As a bonus game in the aforesaid example, the underlying game can dispense an average of twenty coins, maintaining an identical house advantage on the underlying game in addition to the bonus game combination. The bonus game may dispense on average less than twenty coins to increase the house edge. Alternatively, new underlying games may be designed with the bonus game in mind.

Clearly, this same type of bonus game "kick-off mechanism" can be used with the teachings of the present invention. Assuming a player develops the strategy discussed above, the player will uncover the entire hidden pattern 70*a* (FIG. 2) within thirty guesses on almost every instance of the bonus game. Therefore, the house may award the player with thirty guesses in the bonus game in an effort to uncover the entire hidden pattern 70*a*, awarding twenty coins if the hidden pattern 70*a* is indeed uncovered. Alternately, based on the probabilities of finding the hidden pattern 70*a* as a function of the number of guesses, the paytable may be structured with an average payoff of only fifteen coins. An advantage of this approach is that inferior play (play not utilizing a strategy such as the strategy set forth above), whether as a bonus or stand-alone game, adds to the house advantage.

In an alternative embodiment, the underlying game periodically provides means for a guess at the bonus game of the present invention. This is a distinct advantage as typically in bonus games, the entire bonus game is completed in each instance. By tying the underlying game and bonus games together, the player will periodically (randomly in the preferred embodiment) visit the bonus game, thus ensuring suspense and positive feedback through progress within the bonus game. The player is thus encouraged to play the underlying game longer, so as to see the resolution of the bonus game. In such a game, thirty guesses may be too many and so the bonus game may use less guesses. The following sets forth an example.

EXAMPLE

Figure 8:
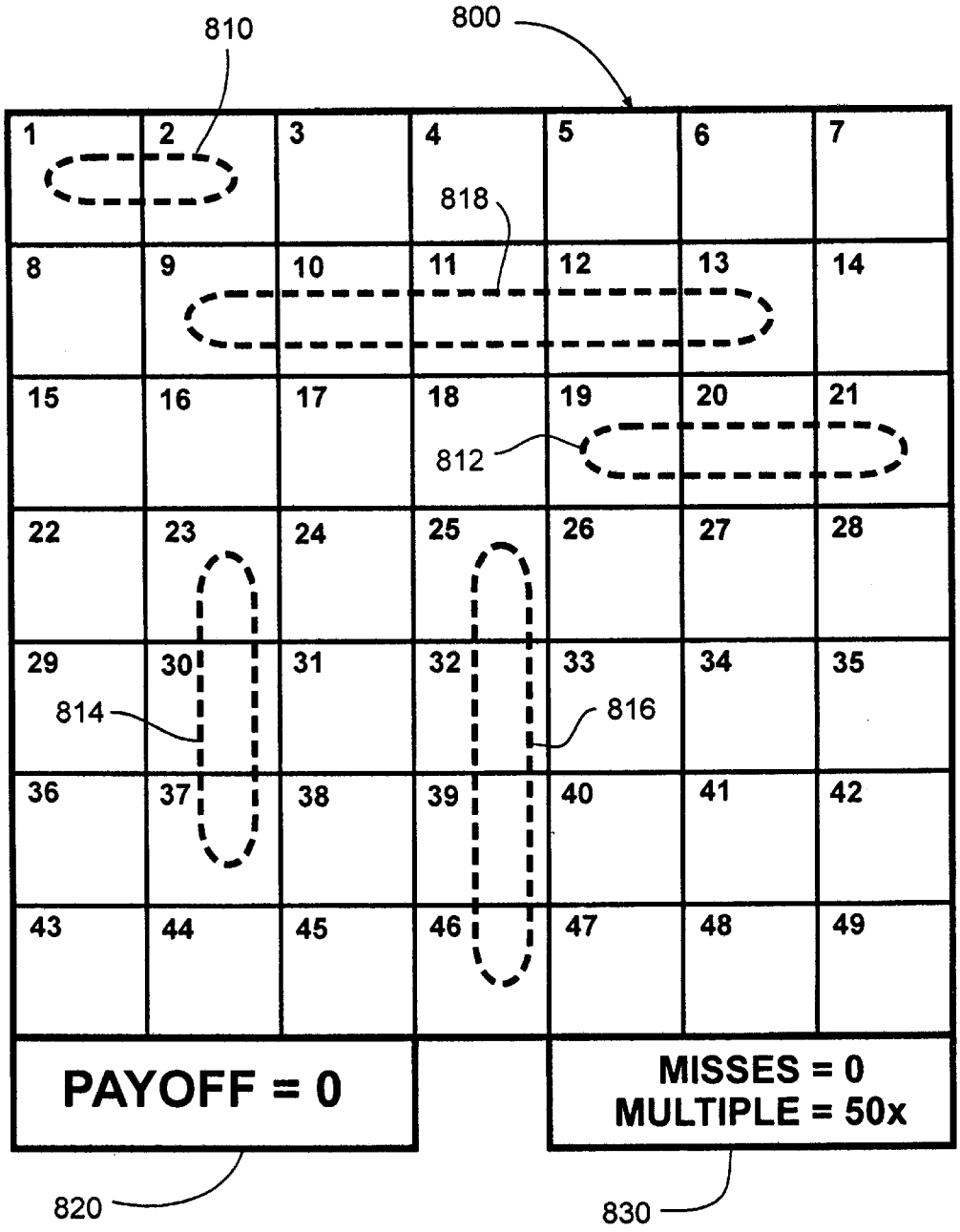
FIGS. 8(*a*), 8(*b*), 8(*c*), and 8(*d*) represent a variation of the method of the present invention used as a bonusing game to an underlying game.
Figure 8:
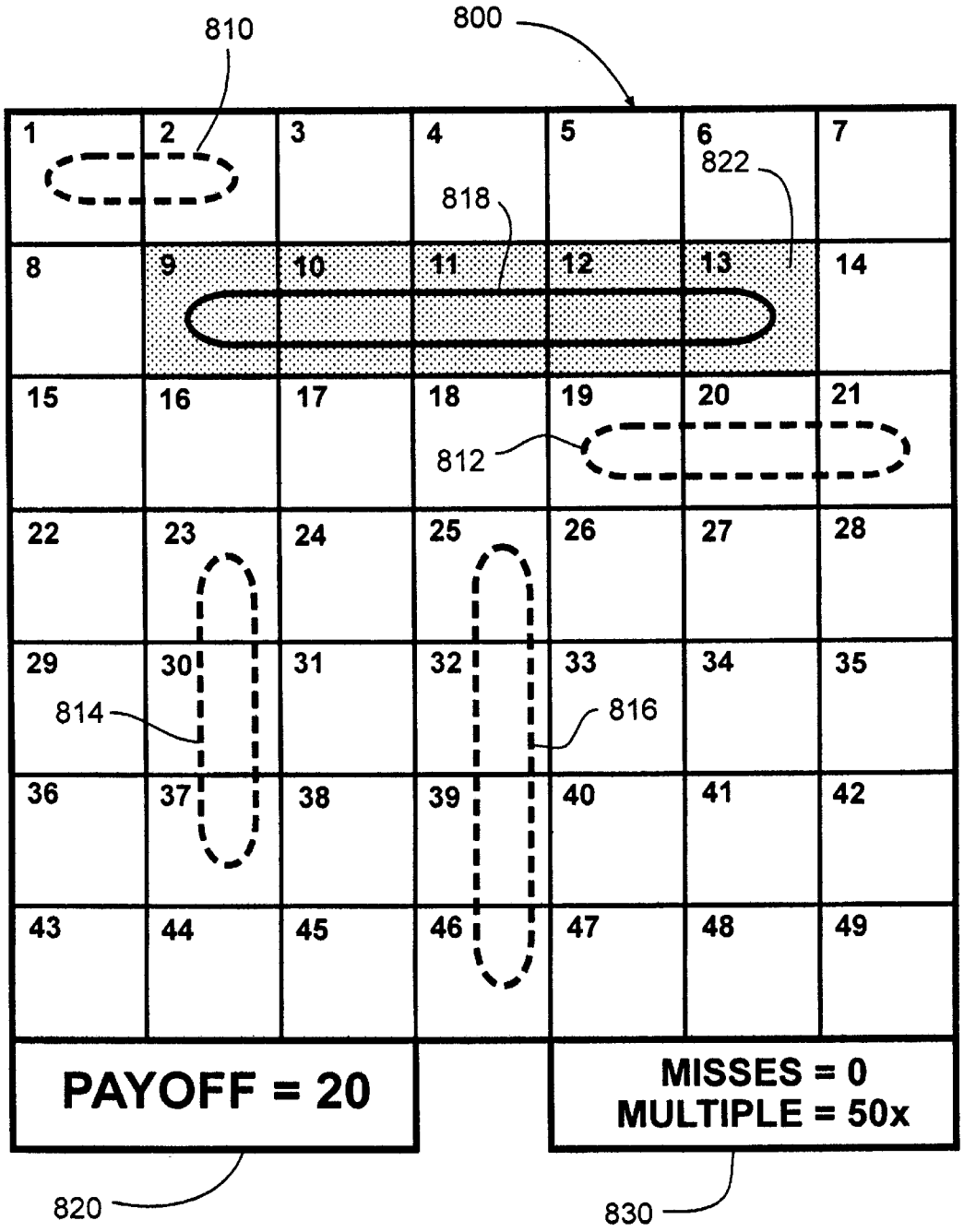
Figure 8:
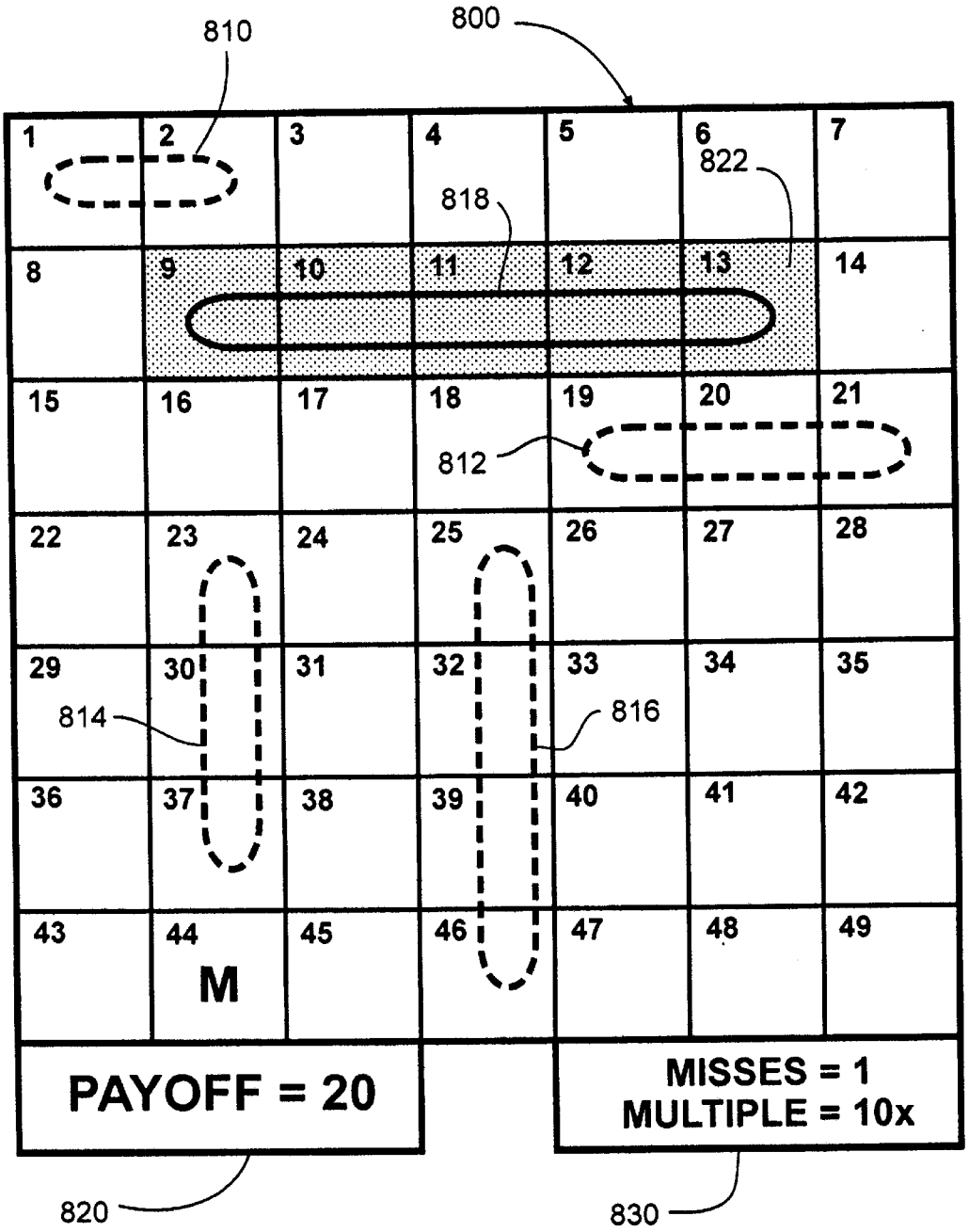
Figure 8:
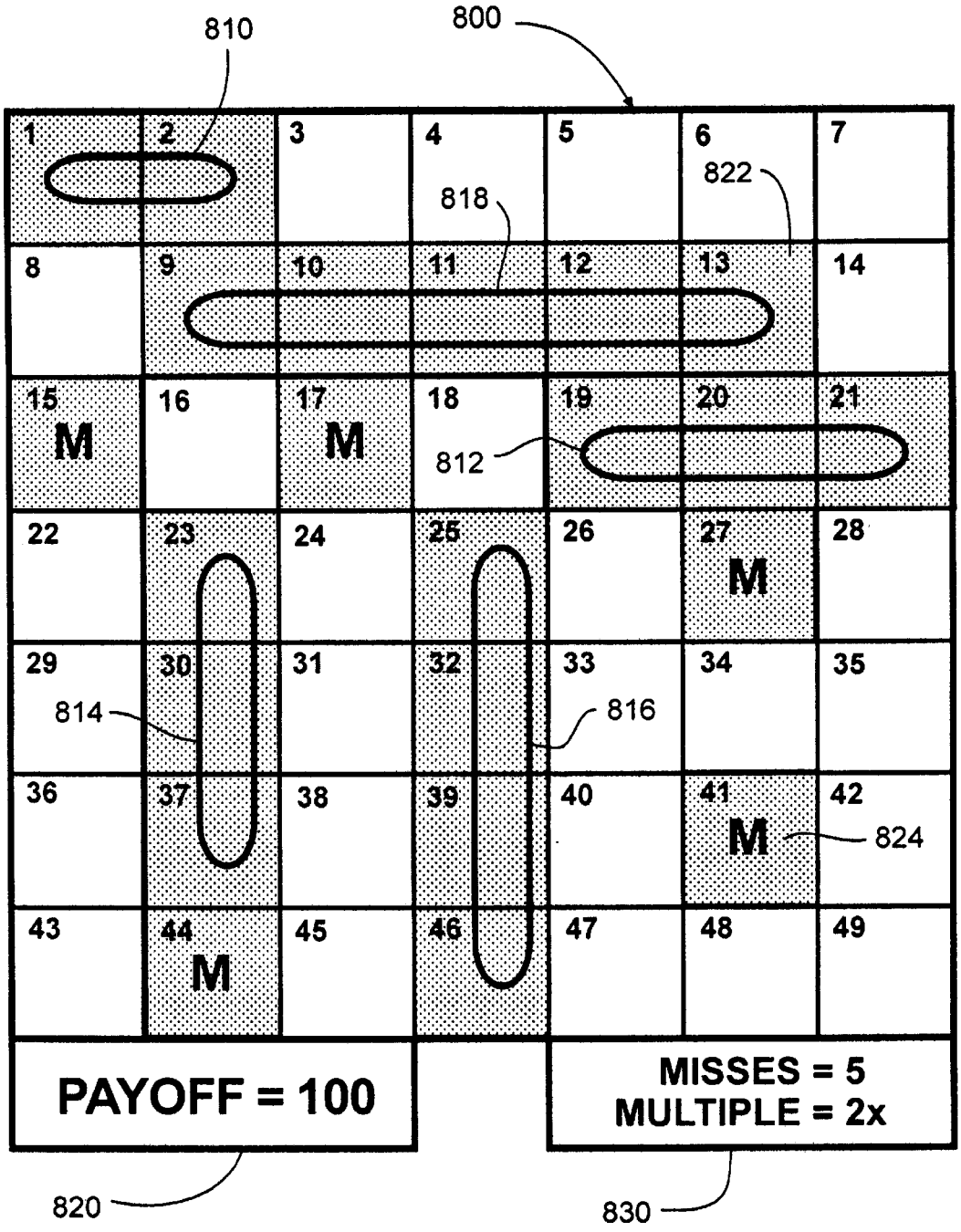

As a preferred embodiment of the method of the present invention and as shown in FIG. 8, consider an underlying slot machine with the present invention utilized as a bonus game. The exact nature of the underlying game is not material, but for purposes of this example, the underlying gaming machine is a conventional slot machine that allows players to wager on five individual paylines. Each payline has an equal chance, 1 in 50, of generating a bonus condition (i.e., on line 25 of FIG. 1) as a result of a symbol combination (or a symbol) which results in a visit to the bonus game of the present invention. Each visit gives the player one guess at the 7×7 game matrix 800.

The virtual matrix is also 7×7, and has the following five hidden patterns (shown by dotted lines in FIG. 8) randomly placed thereon: 1×2 (810), 1×3 (812), 1×3 (814), 1×4 (816), 1×5 (818) (which corresponds to patterns, for example ships, in the BATTLESHIP game). The random method of placement comprises randomly placing the largest hidden pattern (according to the placement algorithm specified above), followed by the next largest, and so forth until all hidden patterns are randomly placed in the virtual matrix.

The method of playing the bonus game in this example follows. Assuming a wager of 1 credit per payline, upon visiting the bonus game, the player is awarded a prize of 5 credits (5× line wager on the payline that provided the bonus combination) just as a conventional payoff in the underlying game causes a credit meter to increment. Thereafter, the player is allowed to guess at one of the 49 matrix elements in the game matrix 800. Should the "guess" result in a "hit" the player is awarded an additional prize of 10 credits (10× line wager) which would also cause the underlying game credit meter to increment by this amount (e.g., signals over line 40 of FIG. 1). Finally, an amount equal to 20 credits (20× line wager) is added to an "escrow award," and the hidden pattern which was "hit" is fully exposed (i.e., a single correct guess exposes the associated hidden pattern). Should the "guess" result in a "miss" the player is not awarded an additional prize. The underlying gaming machine then resumes play.

Upon correctly uncovering the entire compound hidden pattern (consisting of five individual hidden patterns), the player is awarded the cumulative "escrow award" multiplied by a bonus factor, as appears below:

TABLE I

| Number of Misses | Multiple |
|---|---|
| 0 misses | 50× |
| 1 miss | 10× |
| 2 misses | 5× |
| 3 misses | 4× |
| 4 misses | 3× |
| 5 misses | 2× |
| 6+ misses | 1× |

By employing the "smart" strategy given earlier, the average number of guesses required to uncover the entire pattern is 13.9. Hence, on average 13.9×50=695 line plays are necessary to complete the bonus game.

In addition, the chance of finishing the game with 0, 1, 2, 3, 4, and 5 misses is approximately 1 in 437, 112, 47, 25, 17, and 12, respectively. Hence, the average accrued escrow is approximately 161 credits (for a constant one-credit line wager each visit to the bonus game). When the escrow is combined with the 13.9×5=70 credits associated with visiting the bonus and the 5×10=50 credits associated with immediate award for uncovering a hidden pattern, the total value for the bonus game over time is approximately 161+70+50=281 credits.

The 281 credits in 695 line plays result in the bonus being an expected return of 281/695=40%. When coupled with a base game otherwise returning 50%, the entire base game+bonus game total return is 90%, leading to a 10% house advantage for the product.

FIG. 8 illustrates the method of this embodiment in more detail. Assume a player in playing the underlying machine receives a bonus condition providing the player with an opportunity to play the bonus game for the first time. The screen 800 showing the matrix elements 1 through 49 is displayed. The matrix elements 1 through 49 can each bear a number as shown in FIG. 8(*a*) or, as in the game of BATTLESHIP, have the columns numbered and the rows labeled with a letter of the alphabet. Any suitable identification design could be used under the teachings of the present invention. Indeed, no identification could appear in some embodiments of the present invention. Assume in this illustration that the matrix 800 is a touch screen and that it is presented to the player entering the bonus game for the first time, completely blank, as the hidden patterns 810, 812, 814, 816, and 818 (shown in dotted lines) are unknown to the player except to the extent that the player knows this set of hidden patterns have been randomly placed in the virtual matrix. The shape of the hidden patterns as well as the number of matrix entries for each hidden pattern may also be shown at area 130 so that the player understands what is to be uncovered. As illustrate in FIG. 8, the hidden patterns are generically shown as elongated ovals, but it is to be expressly understood that the actual hidden patterns can be any graphic, design, etc. as previously discussed. In adapting the conventional BATTLESHIP game to the game of the present invention, the shapes can be pictures of ships. However, any suitable graphics could be used such as animals (e.g., uncovering animals hidden in a jungle, celebrities, etc.

The player touches matrix element "10" and scores a "hit". As shown in FIG. 8(*b*) elements 9, 10, 11, 12, and 13 become activated 822 to show pattern 818. Also displayed to the player is a suitable display 820 which escrows the payoff value 20 for scoring a "hit" (which as shown in FIG. 8(*a*) is set to 20). Also a display 830 is provided which displays the current status of the player's misses and the multiple value presently in place. At the start of the bonus game in FIG. 8(*a*) the player has zero misses and the multiple is 50× which shown in display 830. It is to be understood that displays 820 and 830 could be located in any suitable location or orientation on a gaming machine and that the method is not limited thereby. Furthermore, these displays are conventionally connected to a controller or CPU 20 such as that shown in FIG. 1.

At this point, the player has received five credits in the underlying game for entering the bonus game, ten credits entered into the meter of the underlying gaming machine for correctly hitting a hidden pattern, and twenty credits in escrow as shown in display 820. Under the method of the present invention, variations on this could occur. For example, an initial payoff for entering the bonus game need not be made or could become a part of the escrow value shown in display 820. Likewise, a payoff credit for hitting a pattern need not be paid in the underlying gaming machine credit meter, and a wide variety of combinations of payoffs back to the player can be designed under the teachings of the present method. For example, in one version the player simply receives credits for hitting and causing the pattern to be fully exposed.

With the first "guess" in this example over, play now returns to the underlying game. Subsequently, the player receives the proper bonus condition from the underlying game to once again play the bonus game and this time the player touches matrix element 41 which is activated 824, but is a "miss" (FIG. 8*c*). The payoff display 820 still shows 20 credits. The display 830 now displays "misses" equal to one and a drop in the multiple according to Table I to 10×.

The bonus game continues in this fashion until, as shown in FIG. 8(*d*), the bonus game is over. The bonus game has been played in parallel with the play of the underlying game as discussed above. As shown in FIG. 8(*d*), the player encountered a total of five "misses" at matrix elements 15, 17, 27, 41, and 44 causing the multiple to be displayed as 2× in display 830 according to Table I. In order to complete the hidden patterns, the player entered the bonus game ten times (five "hits" plus five "misses"). In this example, twenty credits for each uncovered pattern was added to payoff display or meter 820 so that at the end of the bonus game, 100 credits are shown. At the end of the game, the player receives the multiple times the payoff so the player actually receives 200 credits (i.e., 100×2).

The purpose of providing the multiple in display 830 is to encourage players to more skillfully play the game which adds to excitement in the play thereof and provides greater payoffs. It is to be expressly understood that this example is only one embodiment of the method of the present invention and that in other variations, the use of a multiple based upon "misses" may not be present. Indeed, the method of the present invention can be played simply providing payoff values displayed in display 820.

As mentioned before, a desirable feature of this embodiment is that inferior play will lead to a larger house advantage because more guesses, hence more spins on the base game, will be generally needed before receiving the bonus.

The preceding example is merely illustrative and is not meant to limit the teachings of this invention. Alternately, the player may be awarded varying amounts of rewards, and the rules for guessing may be modified to allow multiple guesses, guess until you miss, accumulation of guesses from the underlying game, accumulation of misses from the underlying game, etc. Too, free guesses may be given upon a correct guess, etc.

Generally, the bonus game may be invoked each time a predetermined event occurs, or may be played in parallel with the underlying game in a continuous-type manner. The underlying game may or may not provide a means to establish the number of guesses or misses in the bonus game. The underlying game may only provide the bonus condition to visit the bonus game (i.e., the occurrence of a predetermined event during the underlying game, a function of the wager on the underlying game, or fixed to occur within a known period of play on the underlying game such as every ten games played or every five games lost). Alternatively, the mechanism to participate in or visit the bonus may be random. In addition, the underlying game may provide means to collect guesses for the bonus game (e.g., a combination of symbols on an underlying slot machine) and may allow for more than one guess to be accumulated or taken at once.

Figure 6:
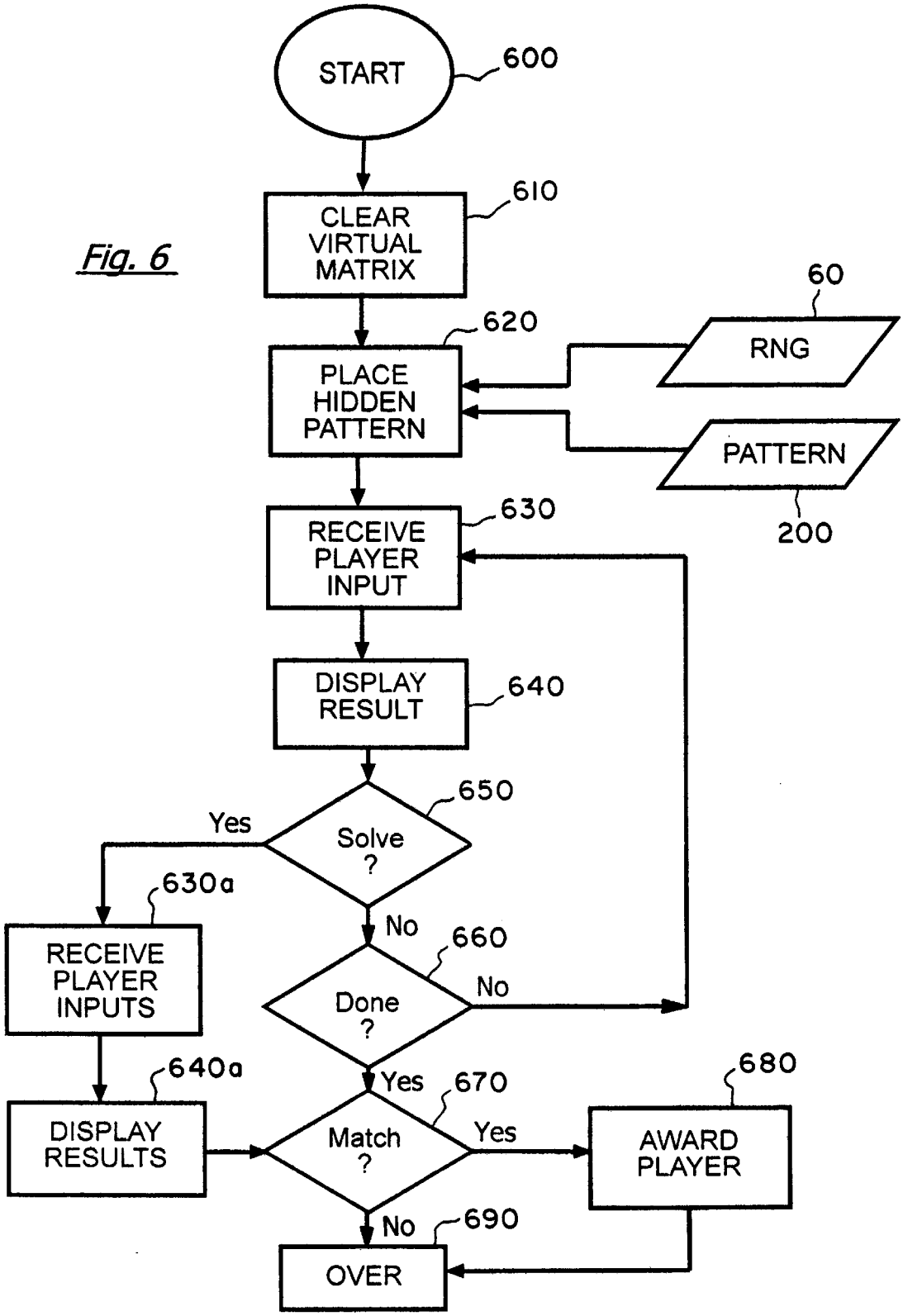
FIG. 6 is a process diagram, depicting the steps of one preferred mode of operation for method of the present invention.

6. Operation FIG. 6 shows the steps of one embodiment for playing the present invention implemented into the system of FIG. 1. The game is started in step 600 upon receiving a signal such as a wager or signal over line 25 from an underlying game that a bonus round is to be played. An i×j virtual matrix 210 in memory 200 is cleared by CPU 20 in step 610. For example, referring to FIG. 4, each grid element may be represented by its row (j) and column 0) or an associated number (k). For purposes of this representation, $k=f(i,j)=5\times(i-1)+j$. Next, a hidden pattern 70, made up of a plurality of matrix entries 75, is chosen by CPU 20 in step 620 from memory. The hidden pattern(s) 70 can always be the same shape(s) from game-to-game or memory 200 may contain a number of patterns that could be randomly selected by the CPU 20 (and random number generator 60), or which could be selected by the player from a menu. In this later case, and not shown in FIG. 6, the CPU 20 in stage 600 would first display patterns in display 100 for selection by the player. Once a pattern 70 is selected (whether the same for each game, randomly selected or player selected), the computer randomly places the pattern 200 in the virtual matrix 210 in stage 620.

The player then selects a visible position 120 from the displayed gaming matrix 110 (e.g., at coordinates (2,3)) in step 630. This is received as an input over lines 80 by the CPU 20. The CPU 20 retrieves the contents for the corresponding position 220 in the virtual memory 200 and displays it in the gaming matrix 110 at the touched visible position as either a "hit" or a "miss."

Stage 650 represents an optional step. In stage 650, the player is given the opportunity to press solve button 30 when a hit occurs in order to solve the pattern by pressing the remaining physical positions 120 of the pattern. Hence, if the player presses solve area 30 (or activate any suitable activation device), in stage 650 the CPU 20 detects the signal over line 85 and causes the operation to enter stage 630*a* to receive the player additional inputs. In the absence of a solve area 30, the present invention would simply continue to step 660 and steps 630*a* and 640*a* would be eliminated. If the player successfully completes a pattern in stages 630*a* and 640*b* by touching the remaining positions, then a match has occurred in stage 670. Stage 680 is entered and the player is awarded a suitable award from the pay table which is stored in memory 200 by the CPU 20. If the player is wrong and no match occurs in stage 670, the game is over in stage 690.

The player continues in the normal play of the game (i.e., without pressing solve area 30) in stage 660. This continues for a requisite number of guesses. Hence, if the player has six guesses, the loop through steps 630 to 660 continues until a counter (not shown) equals six and in stage 660 exits to stage 670. Any suitable number of guesses (in addition to six) may be used to generate a play over signal for a condition to end the game. What has been described is measuring the play over based upon the number of (guesses). It is to be expressly understood that a set certain number of "misses" could be utilized to generate this signal or any other suitable parameter in the play of the game. In addition, a player may activate a solve area 30, described in more detail below.

If the player is successful in completing the hidden pattern, the player is awarded in stage 680. Because the player knows the shape of hidden pattern 70 (since it is displayed 130) or alternatively knows the set of possible shapes from which the hidden pattern was chosen, the present invention is unlike traditional keno, in which the knowledge of one selected number yields no additional information with regard to remaining hidden numbers. The game continues through steps 630 to 660 until the player either completely uncovers hidden pattern 70 or is afforded no more guesses, in which case the game moves to step 670. In step 670, the initial wager and/or the uncovered number of matrix entries 75 are evaluated in order to determine an appropriate payoff in step 680, and then the game ends in step 690. If there are not sufficient matches, the game proceeds to end with step 690.

While the operation shown in FIG. 6 and discussed above is a preferred embodiment, it is to be expressly understood that it represents only one approach to implementing the game of the present invention. This speeds up play of the game. Other equivalent changes to the operation of the present invention can be made.

In summary the method of the present invention allows a player to play a casino game having the following steps: providing a virtual matrix having a plurality of grid elements; randomly associating a hidden pattern on the virtual matrix, the hidden pattern having a plurality of matrix entries, each of the plurality of matrix entries assigned to one of the grid elements; providing a gaming matrix having a plurality of visible portions, each of the plurality of visible portions corresponding to one of the plurality of grid elements; receiving an input signal from the player, the input signal identifying one of the plurality of visible portions on the gaming matrix; determining the input signal to be a hit when the identified visible portion corresponds to a grid element having a matrix entry and to be a miss otherwise; playing on the gaming matrix the matrix entry when the matrix entry is assigned to the corresponding grid element of the virtual matrix in response to receiving the input signal from the player and awarding the player based on the hits and misses. Under this general method, a number of variations can occur. For example, in the step of awarding the player, the step of awarding, in one version, may be based only upon the occurrence of a hit by the player. In other variations, the award to the player may be based solely on misses or a combination of hits and misses. Indeed, an award may only be made when the complete hidden pattern is fully identified based upon the input signals from the player. In addition, the award value awarded to the player can be modified, under the teachings of the present invention, based upon the determination of the input signal from the player to be a miss. In which case, the award value for a given number of misses is greater than or equal to an award value for the given number plus one number of misses. In a typical embodiment under this version, the award value would decrease with each new miss. This would provide incentive to the player to avoid misses in the play of the game. To do so would result in a greater award value. Furthermore, wagering may occur at the beginning of the casino game and/or wagering may occur at various stages within the casino game of the present invention. Of course a hidden pattern can be a permanent hidden pattern for the game, the selection of the hidden pattern to be solved from a plurality of hidden patterns (the choice being made by the player), or the hidden pattern being chosen by the game from a plurality of hidden patterns.

7. Optional Solve Feature. Optionally, a solve feature may be included in step 650. If the player does not wish to solve the puzzle for the hidden pattern, the player continues play of the game by not pressing the solve area 30 and simply continues to guess (e.g., steps 630 through 660) as described above. However, if the solve area 30 is included in the present invention, the player at any point after an inputted result is displayed in stage 640 has the option of solving the puzzle by pressing area 30 on display 100 and then pressing the visible positions 120 under which the remaining entry 75 of the hidden pattern 70 exists. The results are displayed in stage 640*a*. When the requisite number of additional matrix entries of the pattern 70 have been uncovered in stage 630*a* and displayed in stage 640*b*, the player is done and stage 670 is entered to determine whether a match has occurred. It is to be expressly understood that, under this embodiment, when a player is given a number of guesses and when the player presses the solve area 30 early in the guessing game, the player receives a higher payoff. For example, assume a player has six guesses to solve the pattern 70. If, after the first guess, the result is displayed in stage 640, the player activates the solve button 30 and successfully completes the hidden pattern 70, the player receives the highest payoff. However, should the player wait and push the solve area 30 after five prior guesses, then the player receives a much lower payoff if the player is successful in uncovering the entire hidden pattern 70.

Alternatively, rather than waiting for the player to enter all remaining entries after pushing the solve area 30 to make the match in stage 670, the matching could occur with each entry by the player so that when the player misses, the game is immediately over.

8. Keno Modification Alternate Embodiment. In FIG. 7, the conventional game of keno is modified according to the hidden pattern teachings of the present invention as a bonus game. Assume a keno matrix shown in FIG. 7(*a*) is used. This matrix 110*c* has forty-nine visible positions 120*c* which are labeled 1–49. In a conventional fashion, the player may play this game such as at a stand-alone keno video game by touching visible positions 120*c* in which to play the keno underlying game. For example, and as shown in FIG. 7(*a*), the encircled numbers 9, 19, 23, 32, 35, and 43 are the six numbers selected by the player to play the conventional game of keno. It is to be expressly understood that the matrix 110*c* can be of any size with any set of numbers in corresponding visible positions 120*c*. Furthermore, any number of visible positions 120*c*) can be selected by the player to play the keno game. Hence, the player places a wager in the machine and then selects, in this example, the six numbers encircled in FIG. 7(*a*).

The CPU 20 in a conventional fashion and in conjunction with a random number generator 60 (or random number generating software) selects six numbers, and those six numbers are then displayed as shown in FIG. 7(*b*) with the numbers within a rectangle. In FIG. 7(*b*) and in our example, 3, 6, 23, 32, 35, and 46 were randomly selected as the outcome of the conventional keno game. The player in the underlying keno game has three matches. The numbers 23, 32, and 35 are each encircled (player selected) and placed within a square (computer randomly selected). Hence, the player receives a payoff for three correct matches from a Keno pay table which may exist in memory 200. This is conventional play of the underlying Keno game. It is to be understood that the encircling and the placing of numbers and rectangles is simply used as an illustration and that other display devices can easily convey this information to players.

At this point, the pattern feature of the game can be played as a bonus game according to the method of the present invention. This can be automatic so that at the end of every keno game, the player is given the opportunity to complete the pattern as a bonus game. Or, the player may be required to wager the winnings of the keno game, to place a separate wager, or push a separate button, or otherwise activate the bonus game over lines 25.

When this occurs, at least four alternate embodiments exist. The first embodiment in FIG. 7(*c*) simply turns over the player selected (i.e., encircled) positions of 9, 19, 23, 32, 35, and 43. This uncovers, as shown in FIG. 7(*c*), behind player selected positions 32 and 35 two matrix entries 75*c* of the hidden pattern 70*c*. Nothing is displayed at locations 9, 19, 23, and 43. The player knows that the hidden pattern is a bar having four spaces from area 130 and, hence, easily solves the bonus game by pressing areas 33 and 34 to complete the hidden pattern. This is an easy bonus win for this player. The four matrix bar 70*c*, of course, is randomly oriented anywhere within the overall matrix of 1 through 49 positions. In this case, the player playing the underlying keno game had three keno matches, received a suitable payoff and then went on to the opportunity to solve the bonus game of the present invention to receive a bonus payoff. In a second embodiment only the keno randomly selected numbers are uncovered.

In the third embodiment illustrated in FIG. 7(*d*), the player selected numbers (i.e., encircled) and the randomly selected numbers (i.e., placed in squares) are each uncovered, as shown in FIG. 7(*d*). This results in the same information to the player who then proceeds to press locations 33 and 34 to complete the pattern and win the bonus game. This embodiment provides more spaces that are uncovered and, therefore, a greater chance of solving the bonus game. In the fourth embodiment, only the visible positions that correspond to both the player selected and the keno game randomly selected numbers would be uncovered (i.e., 23, 32, and 35 in FIG. 7*b*). This provides a more difficult game. Of course, other equivalent embodiments are possible .

It is to be expressly understood that under either embodiment, the player is given either automatically, upon the basis of a separate wager, or any other suitable activation approach, a chance to participate in a pattern recognition game in conjunction with the underlying standard keno game.

In the preferred embodiment, the pattern (such as the four matrix entry bar 70*c*, as shown in FIG. 7(*c*) and 7(*d*), is preferably displayed such as being printed on or near the screen 100. However, it is to be expressly understood that with each keno game a new pattern can be randomly selected and first displayed to the player to recognize the pattern before playing the keno game. Or, that the player can select which pattern to play from a database. Many alternatives can be incorporated under the teachings of the present invention.

The above disclosure sets forth a number of embodiments of the present invention. Those skilled in this art will however appreciate that other arrangements or embodiments, not precisely set forth, could be practiced under the teachings of the present invention. For example, while a virtual memory has been disclosed into which the hidden pattern is randomly placed, any suitable software, hardware, and/or combination thereof design can be used to functionally associate the hidden pattern to the gaming matrix. For example, a wide variety of designs could be utilized to provide the gaming matrix with visible portions such as a back lit panel, a matrix of liquid crystal displays, etc. Therefore, the scope of this invention should only be limited by the scope of the following claims and not by the title, the abstract, the background of the invention, and/or the summary of the present invention.

We claim:

1. A method for a player to play a casino game, the method comprising the steps of:

providing a virtual matrix having a plurality of grid elements;

randomly associating a hidden pattern on said virtual matrix, said hidden pattern having a plurality of matrix entries, each of said plurality of matrix entries assigned to one of said plurality of grid elements;

providing a gaming matrix having a plurality of visible positions, each of said plurality of visible positions corresponding to one of said plurality of grid elements;

receiving input signals from the player for predetermined number of visible positions each one of said input signals identifying one of said plurality of visible positions on said gaming matrix;

determining the input signal to be a hit when the identified visible position corresponds to a grid element having a matrix entry and to be a miss otherwise;

displaying on said gaming matrix the corresponding grid element of the virtual matrix in response to receiving the input signal from the player;

awarding the player based on hits and misses of the hidden pattern.

2. The method of claim 1 wherein the step of awarding the player only occurs when the input signal is determined to be a hit.

3. The method of claim 1 further comprising the step of activating a media presentation in response to the step of determining the input signal to be a hit.

4. A method for a player to play a casino game, the method comprising the steps of:

providing a virtual matrix having a plurality of grid elements;

randomly associating a hidden pattern on said virtual matrix, said hidden pattern having a plurality of matrix entries, each of said plurality of matrix entries assigned to one of said plurality of grid elements;

providing a gaming matrix having a plurality of visible positions, each of said plurality of visible positions corresponding to one of said plurality of grid elements;

receiving input signals from the player for a predetermined number of visible positions, each one of an input signal from the player, said input signal identifying one of said plurality of visible positions on said gaming matrix;

determining the input signal to be a hit when the identified visible position corresponds to a grid element having a matrix entry and to be a miss otherwise;

displaying on said gaming matrix the corresponding grid element of the virtual matrix in response to receiving the input signal from the player wherein the step of displaying further displays on the gaming matrix all of the remaining plurality of matrix entries of the hidden pattern thereby fully displaying the hidden pattern on said gaming matrix;

awarding the player based on hits and misses of the hidden pattern.

5. The method of claim 1 further comprising the step of receiving the hidden pattern from the player, said hidden pattern chosen by the player from a plurality of hidden patterns before the step of randomly placing the hidden pattern on the virtual matrix.

6. The method of claim 1 further comprising the step of randomly selecting a hidden pattern from a plurality of hidden patterns.

7. A method for a player to play a casino game, the method comprising the steps of:

providing a virtual matrix having a plurality of grid elements;

randomly associating a hidden pattern on said virtual matrix, said hidden pattern having a plurality of matrix entries, each of said plurality of matrix entries assigned to one of said plurality of grid elements;

providing a gaming matrix having a plurality of visible positions, each of said plurality of visible positions corresponding to one of said plurality of grid elements;

receiving an input signal from the player, said input signal identifying one of said plurality of visible positions on said gaming matrix;

determining the input signal to be a hit when the identified visible position corresponds to a grid element having a matrix entry and to be a miss otherwise;

displaying on said gaming matrix the matrix entry when said matrix entry is assigned to the corresponding grid element of the virtual matrix in response to receiving the input signal from the player;

awarding the player a value based on hits and misses;

modifying the award value in response to the step of determining the input signal to be a miss wherein the modified award value for a given number of misses is greater than or equal to a modified award value for the given number plus one number of misses.

8. The method of claim 1 wherein the step of determining the input signal to be a hit includes the steps of receiving an additional input signals from the player and wherein the step of awarding the player provides a further award when all of the aforesaid input signals are hits so as to fully display the hidden pattern on said gaming matrix.

9. The method of claim 1 further comprising the step of receiving a wager before the step of receiving the input signal from the player.

10. A method for a player to play a casino game, the method comprising the steps of:

providing a virtual matrix having a plurality of grid elements;

randomly associating a hidden pattern on said virtual matrix, said hidden pattern having a plurality of matrix entries, each of said plurality of matrix entries assigned to one of said plurality of grid elements;

providing a gaming matrix having a plurality of visible positions, each of said plurality of visible positions corresponding to one of said plurality of grid elements;

receiving a bonus condition from an underlying game;

receiving input signals from the player for a predetermined number of visible positions and adding each one of said input signal identifying one of said plurality of visible positions on said gaming matrix;

determining the input signal to be a hit when the identified visible position corresponds to a grid element having a matrix entry and to be a miss otherwise;

displaying on said gaming matrix the matrix entry when said matrix entry is assigned to the corresponding grid element of the virtual matrix in response to receiving the input signal from the player;

awarding the player based on hits and misses of the hidden pattern.

11. A method for playing a casino game, the method comprising the steps of:

(a) providing a virtual matrix having a plurality of grid elements;

(b) randomly placing a hidden pattern on said virtual matrix, said hidden pattern having a plurality of matrix entries, each of said plurality of matrix entries assigned to one of said plurality of grid elements;

(c) providing a gaming matrix having a plurality of visible positions, each of said plurality of visible positions corresponding to one of said plurality of grid elements;

(d) receiving an input signal from a player, said input signal corresponding to at least one of said plurality of visible positions on said gaming matrix;

(e) determining the input signal to be a hit when the identified visible position corresponds to a grid element having a matrix entry and to be a miss otherwise;

(f) displaying on said gaming matrix the corresponding grid element of the virtual matrix in response to receiving the input signal from the player;

(g) repeating steps (d) through (f) until a play-over signal is received;

(h) awarding the player in response to receiving at least one input signal determined to be a hit.

12. A method for playing a casino game, the method comprising the steps of:

(a) providing a virtual matrix having a plurality of grid elements;

(b) randomly placing a hidden pattern on said virtual matrix, said hidden pattern having a plurality of matrix entries, each of said plurality of matrix entries assigned to one of said plurality of grid elements;

(c) providing a gaming matrix having a plurality of visible positions, each of said plurality of visible positions corresponding to one of said plurality of grid elements;

(d) receiving an input signal from a player, said input signal corresponding to at least one of said plurality of visible positions on said gaming matrix;

(e) determining the input signal to be a hit when the identified visible position corresponds to a grid element having a matrix entry and to be a miss otherwise;

(f) displaying on said gaming matrix the corresponding grid element of the virtual matrix in response to receiving the input signal from the player;

(g) repeating steps (d) through (f) until a play-over signal is received; generating the play-over signal in response to repeating steps d) and e) for a predetermined number of repetitions;

(h) awarding the player in response to receiving at least one input signal determined to be a hit.

13. A method for playing a casino game, the method comprising the steps of:

(a) providing a virtual matrix having a plurality of grid elements;

(b) randomly placing a hidden pattern on said virtual matrix, said hidden pattern having a plurality of matrix entries, each of said plurality of matrix entries assigned to one of said plurality of grid elements;

(c) providing a gaming matrix having a plurality of visible positions, each of said plurality of visible positions corresponding to one of said plurality of grid elements;

(d) receiving input signals from the player for a predetermined number of visible positions and adding each one said input signal corresponding to at least one of said plurality of visible positions on said gaming matrix;

(e) determining the input signal to be a hit when the identified visible position corresponds to a grid element having a matrix entry and to be a miss otherwise;

(f) displaying on said gaming matrix the corresponding grid element of the virtual matrix in response to receiving the input signal from the player;

(g) repeating steps (d) through (f) until a play-over signal is received; generating the play-over signal in response to a predetermined number of misses occurring;

(h) awarding the player in response to receiving at least one input signal determined to be a hit.

14. The method of claim 11 further comprising the step of generating the play-over signal in step g) in response to receiving a solve signal from the player.

15. The method of claim 11 further comprising the step of activating a first media presentation in response to the step f) wherein the corresponding grid element contains said matrix entry.

16. A method for playing a casino game, the method comprising the steps of:

(a) providing a virtual matrix having a plurality of grid elements;

(b) randomly placing a hidden pattern on said virtual matrix, said hidden pattern having a plurality of matrix entries, each of said plurality of matrix entries assigned to one of said plurality of grid elements;

(c) providing a gaming matrix having a plurality of visible positions, each of said plurality of visible positions corresponding to one of said plurality of grid elements;

(d) receiving an input signal from a player, said input signal corresponding to at least one of said plurality of visible positions on said gaming matrix;

(e) determining the input signal to be a hit when the identified visible position corresponds to a grid element having a matrix entry and to be a miss otherwise;

(f) displaying on said gaming matrix the corresponding grid element of the virtual matrix in response to receiving the input signal from the player;

(g) repeating steps (d) through (f) until a play-over signal is received;

(h) awarding the player in response to receiving at least one input signal determined to be a hit, activating a second media presentation when the corresponding grid element contains said empty indicator.

17. The method of claim 11 further comprising the step of allowing the player to select the hidden pattern from a plurality of hidden patterns before the step b) of randomly placing the hidden pattern on the virtual matrix.

18. A method for playing a casino game, the method comprising the steps of:

(a) providing a virtual matrix having a plurality of grid elements;

(b) randomly placing a hidden pattern on said virtual matrix, said hidden pattern having a plurality of matrix entries, each of said plurality of matrix entries assigned to one of said plurality of grid elements;

(c) providing a gaming matrix having a plurality of visible positions, each of said plurality of visible positions corresponding to one of said plurality of grid elements;

(d) receiving input signals from the player for a predetermined number of visible positions and adding each one of said input signal corresponding to at least one of said plurality of visible positions on said gaming matrix;

(e) determining the input signal to be a hit when the identified visible position corresponds to a grid element having a matrix entry and to be a miss otherwise;

(f) displaying on said gaming matrix the corresponding grid element of the virtual matrix in response to receiving the input signal from the player;

(g) repeating steps (d) through (f) until a play-over signal is received;

(h) awarding the player a value in response to receiving at least one input signal determined to be a hit; modifying the award value in response to the step of determining the input signal to be a miss wherein the modified award value for a given number of misses is greater than or equal to a modified award value for the given number plus one number of misses.

19. The method of claim 11 wherein the step h) of awarding the player further includes the step of receiving an additional input signal from the player.

20. The method of claim 11 further comprising the step of receiving a wager before the step d) of receiving the input signal from the player.

21. The method of claim 11 further comprising the step of receiving a bonus signal from an underlying game before the step d) of receiving the input signal from the player.

22. A method for a player to play a casino game, the method comprising the steps of:

(a) providing a virtual matrix having a plurality of grid elements;

(b) randomly placing a hidden pattern on said virtual matrix, said hidden pattern having a plurality of matrix entries;

(c) providing a gaming matrix having a plurality of visible positions, each of said plurality of visible positions corresponding to one of said plurality of grid elements;

(d) receiving a bonus signal from an underlying game;

(e) receiving an input signal from a player, said input signal corresponding to at least one of said plurality of visible positions on said gaming matrix, in response to receiving the bonus signal from the underlying game;

(f) displaying on said gaming matrix the corresponding grid element of the virtual matrix in response to receiving the input signal from the player; and (g) returning to said underlying game in response to an unmatched input signal.

23. The method of claim 22 further comprising the steps of:

(a) waiting for a predetermined time period to receive a solve signal in response to a matched input signal;

(b) repeating steps e) through g) in response to receiving the solve signal;

(c) returning to said underlying game in response to the end of said predetermined time period.

24. The method of claim 22 further comprising the step of awarding the player in response to displaying each matrix entry of the hidden pattern on said gaming matrix.

25. The method of claim 22 further comprising the step of awarding the player in response to displaying all matrix elements in the hidden pattern.

26. A method for a player to play a bonus game while playing an underlying game, the method comprising the steps of:

starting play of the bonus game when a first bonus condition occurs in the play of the underlying game, randomly associating a plurality of hidden patterns in a gaming matrix having a plurality of grid elements displayed to a player, playing the bonus game in the following steps:

(a) receiving an input signal from the player corresponding to one of said plurality of grid elements on said displayed gaming matrix, (b) indicating all grid elements forming a hidden pattern in one of said plurality of hidden patterns as a hit in said displayed gaming matrix when said input signal corresponds to a grid element of the aforesaid hidden pattern, (c) adding an escrow value to an escrow display in response to the step of indicating a hit, (d) indicating only the grid element receiving said input signal as a miss when the aforesaid grid element does not form a part of any of said plurality of hidden patterns, and (e) repeating steps (a) through (d) for each subsequent bonus condition occurring in the play of the underlying game until all of said plurality of hidden patterns are indicated as a hit, awarding the player a value based on the final escrow value shown in the escrow display.

27. The method of claim 26 further comprising the steps of:

determining the number of misses in response to the step of indicating a miss, associating a multiple value to the determined number of misses, said multiple value being higher for a low number of misses and said multiple value being lower for a high number of misses, awarding the player the associated multiple value times the final escrow value.

28. The method of claim 27 wherein the associated multiple value is selected from a predetermined number of multiple values in a range.

29. The method of claim 26 further comprising the step of awarding the player a bonus payoff for each bonus condition occurrence.

30. The method of claim 26 further comprising the step of awarding the player a bonus payoff in response to indicating a hit.

31. A method for a player to play a bonus game while playing an underlying game, the method comprising the steps of:

starting play of the bonus game when a first bonus condition occurs in the play of the underlying game, randomly associating at least one hidden pattern in a gaming matrix having a plurality of grid elements displayed to a player, playing the bonus game in the following steps:

(a) receiving an input signal from the player corresponding to one of said plurality of grid elements on said displayed gaming matrix, (b) indicating the one grid element forming said at least one hidden pattern as a hit in said displayed gaming matrix when said input signal corresponds to a grid element of the at least one hidden pattern, (c) adding an escrow value to an escrow display in response to the step of indicating a hit, (d) indicating the one grid element receiving said input signal as a miss when the aforesaid grid element does not form a part of said at least one hidden pattern, and (e) repeating steps (a) through (d) for each subsequent bonus condition occurring in the play of the underlying game until all of the grid elements forming said at least one hidden pattern are indicated as a hit, awarding the player based on the final escrow value shown in the escrow display.

32. The method of claim 31 further comprising the steps of:

determining the number of misses in response to the step of indicating a miss, associating a multiple value to the determined number of misses, said multiple value being higher for a low number of misses and said multiple value being lower for a high number of misses, awarding the player the associated multiple value times the final escrow value.

33. The method of claim 32 wherein the associated multiple value is selected from a predetermined number of multiple values in a range.

34. The method of claim 31 further comprising the step of awarding the player a bonus payoff for each bonus condition occurrence.

35. The method of claim 31 further comprising the step of awarding the player a bonus payoff in response to indicating a hit.

36. The method of claim 10 wherein the step of displaying displays all remaining matrix entries when the first matrix entry is hit.

37. The method of claims 11, 12, 13, 16, and 18 further comprising the step of repeating steps (d) through (f) until each matrix element of the hidden pattern is displayed on the gaming matrix in response to the step of receiving the playover signal.

38. The method of claims 11, 12, 13, 16, and 18 further comprising the step of repeating steps (d) through (f) until an empty indicator occurs in response to the step of receiving the playover signal.

39. A method for a player to play a casino bonus game having a display and a processor, the method comprising the steps of:

(a) randomly associating in the processor a hidden pattern having a plurality of matrix entries on a gaming matrix having a plurality of visible positions on the display, one matrix entry associated with one visible position;

(b) receiving a bonus signal in the processor from an underlying casino game;

(c) receiving an input signal in the processor from a player, the input signal corresponding to the selection of a visible position on the gaming matrix in the display;

(d) displaying on the gaming matrix at the selected visible position the associated matrix entry of the hidden pattern in response to receiving the input signal from the player; and (e) returning to the underlying casino game when an associated matrix entry of the hidden pattern is not associated with the selected visible position.

40. The method of claim 39 further comprising the steps of:

(f) waiting for a predetermined time period to receive a solve signal in the processor from the player when an associated matrix entry of the hidden pattern is displayed in response to the step of displaying;

(g) repeating steps c) through e) in response to receiving the solve signal;

(h) returning to the underlying game in response to the end of the predetermined time period.

41. The method of claim 40 further comprising the step of awarding the player in response to the step of displaying each matrix entry of the hidden pattern on said gaming matrix.

42. The method of claim 40 further comprising the step of awarding the player in response to displaying all matrix entries in the hidden pattern.

43. A method for a player to play a bonus casino game while playing an underlying casino game, the method comprising the steps of:

starting play of the bonus casino game in a processor when a bonus condition occurs in the play of the underlying casino game, playing the bonus casino game in the processor with at least the following steps:

(a) randomly associating in the processor a hidden pattern in a gaming matrix, the gaming matrix having a plurality of elements displayed to a player in a display, (b) receiving an input signal in the processor from the player corresponding to one of the plurality of elements on the displayed gaming matrix, (c) indicating in the display to the player the one element as a hit when the one grid is part of the hidden pattern, (d) indicating in the display to the player the one element as a miss when the grid is not part of the hidden pattern, (e) adding a value to a display in response to the step of indicating a hit.

44. The method of claim 43 further comprising the steps of:

repeating steps (a) through (e) for each subsequent bonus condition occurring in the play of the underlying casino game until all elements of the hidden pattern are indicated as a hit, awarding the player based on the final value shown in the display when the entire hidden pattern is indicated as hits.

45. The method of claim 43 further comprising the steps of:

determining the number of misses in response to the step of indicating a miss, associating a multiple value to the determined number of misses, said multiple value being higher for a low number of misses and said multiple value being lower for a high number of misses, awarding the player the associated multiple value times the final value.

46. The method of claim 45 wherein the associated multiple value is selected from a predetermined number of multiple values in a range.

47. The method of claim 43 further comprising the step of awarding the player a bonus payoff for each bonus condition occurrence.

48. The method of claim 43 further comprising the step of awarding the player a bonus payoff in response to indicating a hit.

49. A method for a player to play a casino bonus game in a bonus game display and a processor, the method comprising the steps of:

randomly associating in the processor receiving a hidden pattern having a plurality of entries to a game matrix, the game matrix having a plurality of visible positions on the bonus game display, one hidden pattern entry associated with one visible position;

receiving a bonus signal in the processor from an underlying casino game;

receiving an input signal in the processor from a player in response to the bonus signal receipt and random association steps, the input signal corresponding to the selection by the player of a visible position on the game matrix in the bonus game display;

displaying the entire hidden pattern on the game matrix when the selected visible position has an associated entry of the hidden pattern in response to receiving the input signal from the player;

awarding the player when the entire hidden pattern is displayed.

50. A method for a player to play a casino bonus game in a display and a processor, the method comprising the steps of:

randomly associating, under control of the processor, a hidden pattern having a plurality of entries to the display, the display having a plurality of visible positions, each hidden pattern entry associated with one visible position;

receiving a bonus signal in the processor from an underlying casino game;

receiving at least one input signal in the processor from a player, the at least one input signal corresponding to the selection by the player of a visible position on the display;

revealing, under control of the processor, the entire hidden pattern on the display when the selected visible position has an associated entry of the hidden pattern in response to receiving the input signal from the player;

awarding, under control of the processor, the player when the entire hidden pattern is displayed in the display.

51. The method of claim 50 wherein a predetermined number of input signals are received from the player.

52. The method of claim 50 wherein the plurality of visible portions form a two dimensional matrix.

53. The method of claim 50 further comprising the step of ending the casino bonus game in response to revealing the entire hidden pattern.

54. The method of claim 50 further comprising the step of ending the casino bonus game when the selected visible portion does not have an associated entry of the hidden pattern.

55. The method of claim 50 comprising the step of:

continuing the casino bonus game for each next bonus signal (1) as long as the player continues to play the underlying game and (2) when the selected visible position does not have an associated entry of the hidden pattern, preventing the step of randomly associating from occurring so that the random association of the hidden pattern to the display remains fixed.

56. The method of claim 55 wherein the display shows each selected visible portion as a miss when the selected visible portion does not have an associated entry of the hidden pattern until the hidden pattern is revealed.

57. The method of claim 50 wherein for each next bonus signal as long as the player is playing the underlying game, the step of randomly associating occurs.

58. The method of claim 50 wherein for each next bonus signal as long as the player is playing the underlying game, the step of randomly associating includes the step of selecting a different random pattern.

59. The method of claim 50 wherein the steps of randomly associating and awarding occur in any order.

60. The method of claim 50 wherein the steps of revealing and awarding occur in any order.

61. A method for a player to play a casino bonus game in a display and a processor, the method comprising the steps of:

randomly associating, under control of the processor, a plurality of hidden patterns having a plurality of entries to the display, the display having a plurality of visible positions, each hidden pattern entry associated with one visible position;

receiving a bonus signal in the processor from an underlying casino game;

receiving a predetermined number of input signals in the processor from a player, the at least one input signal corresponding to the selection by the player of a visible position on the display;

revealing, under control of the processor, the entire hidden pattern on the display when the selected visible position has an associated entry of one of the plurality of hidden patterns in response to receiving an input signal from the player;

awarding, under control of the processor, the player a first award when each entire hidden pattern is displayed in the display and a second award when all of the plurality of hidden patterns are revealed, ending the casino bonus game after the predetermined number of inputs occur or when all hidden patterns are revealed.

62. A method for a player to play a casino bonus game having a display and a processor, the method comprising the steps in any order of;

receiving a bonus signal in the processor from an underlying casino game to start play of the bonus game;

randomly associating in the processor at least one hidden pattern having a plurality of entries on a gaming matrix, the gaming matrix having a plurality of visible positions on the display, one entry associated with one visible position; and, then comprising the steps in the order of:

(a) receiving an input signal in the processor from a player during play of the casino bonus game, the input signal corresponding to a selection by the player of a visible position on the gaming matrix in the display;

(b) displaying on the gaming matrix at the selected visible position the associated entry of the hidden pattern in response to receiving the input signal from the player;

(c) repeating steps (a) and (b) for a predetermined number of input signals from the player.

63. The method of claim 62 further comprising the step of:

awarding the player on the display when each entry of the at least one hidden pattern is uncovered.

64. The method of claim 62 further comprising the step of:

awarding the player on the display when all of the entries of one of the at least one hidden pattern are uncovered.

65. The method of claim 62 further comprising the step of awarding the player when all of the entries of all of the at least one hidden patterns are uncovered.

66. A method for a player to play a casino bonus game having a display and a processor, the method comprising the steps of:

receiving a bonus signal in the processor from an underlying casino game to start play of the bonus game;

randomly associating in the processor a plurality of hidden patterns, each hidden pattern having a plurality of entries on the display, the display having a plurality of visible positions, one matrix entry associated with one visible position;

receiving an input signal in the processor from a player during play of the casino bonus game, the input signal corresponding to a selection by the player of a visible position on the display;

displaying a hit on the display at the selected visible position having an the associated matrix entry of one of the plurality of hidden patterns in response to receiving the input signal from the player;

displaying a miss on the display at the selected visible position not having an associated entry of one of the plurality of hidden patterns.

repeating the aforesaid three steps in order for a predetermined number of input signals from the player, awarding the player with a first award when a hit occurs, with a second award when one of the plurality of hidden patterns is uncovered, and with a third award when all of the plurality of hidden patterns are uncovered.

* * * * *